US008127690B2

(12) United States Patent
Baughman

(10) Patent No.: US 8,127,690 B2
(45) **Date of Patent: *Mar. 6, 2012**

(54) PORTABLE WORKSTATION

(76) Inventor: Joe D. Baughman, Leeds, UT (US)

( * ) Notice: Subject to any disclaimer, the term of this patent is extended or adjusted under 35 U.S.C. 154(b) by 721 days.

This patent is subject to a terminal disclaimer.

(21) Appl. No.: 12/175,315

(22) Filed: Jul. 17, 2008

(65) Prior Publication Data

US 2008/0271648 A1 Nov. 6, 2008

Related U.S. Application Data

(63) Continuation-in-part of application No. 11/248,825, filed on Oct. 12, 2005, now Pat. No. 7,901,018.

(60) Provisional application No. 60/618,428, filed on Oct. 13, 2004.

(51) Int. Cl.
*A47B 37/00* (2006.01)

(52) U.S. Cl. ..... 108/50.11

(58) Field of Classification Search ..... 108/77, 108/80, 16, 33, 38, 35, 50.11; 280/30; 312/240, 312/241, 313, 317.3, 280, 281, 237; 190/11, 190/117, 12 A, 39, 115; 248/188.7, 188.8
See application file for complete search history.

(56) References Cited

U.S. PATENT DOCUMENTS

| | | | | | |
|---|---|---|---|---|---|
| 122,554 | A | * | 1/1872 | Bostrom | 108/77 |
| 123,172 | A | * | 1/1872 | Hoese | 108/77 |
| 363,372 | A | | 5/1887 | Dollens | |
| 1,326,809 | A | | 12/1919 | Twiss | |
| 1,478,371 | A | | 12/1923 | Albrighton | |
| 2,206,004 | A | | 6/1940 | Ford | |
| 2,351,610 | A | | 6/1944 | Hamberg | |
| 2,393,598 | A | * | 1/1946 | Doty et al. | 108/96 |
| 2,497,156 | A | | 2/1950 | Davis | |
| 3,752,476 | A | * | 8/1973 | Mahoney | 248/188.7 |
| 3,866,994 | A | | 2/1975 | Bonin | |
| 3,915,529 | A | | 10/1975 | Bernier | |
| 3,994,461 | A | * | 11/1976 | Dorantes | 248/188.7 |
| 4,036,462 | A | * | 7/1977 | Sheftel | 248/188.7 |
| 4,053,129 | A | * | 10/1977 | Graff | 248/188.7 |
| 4,436,353 | A | | 3/1984 | Tucker | |
| 4,919,109 | A | | 4/1990 | Riley | |
| 4,934,280 | A | | 6/1990 | Bae | |
| 5,249,438 | A | * | 10/1993 | Rhaney et al. | 190/115 |
| 5,492,301 | A | * | 2/1996 | Hauser | 248/188.7 |
| 5,518,258 | A | | 5/1996 | Cox | |
| 5,706,921 | A | | 1/1998 | Wang | |
| 5,913,270 | A | | 6/1999 | Price | |
| 5,941,352 | A | | 8/1999 | Lee | |
| 6,053,587 | A | | 4/2000 | Boerder | |

(Continued)

*Primary Examiner* — Jose V Chen
(74) *Attorney, Agent, or Firm* — Kunzler Needham Massey & Thorpe

(57) ABSTRACT

A portable workstation, in one embodiment, includes a base unit and a table. The base unit includes one or more vertical support members and a platform extending horizontally from the vertical support member. Support legs telescopically extend laterally to support the workstation in an upright position. The platform forms the top of the base unit in an upright position. The table is configured to extend from the base unit and includes a support leg. The table transitions between an extended position and a storage position. When the support legs are in the extended position, the table and support legs provide support to the base unit of the workstation, forming an integrated tripod system. Thus, the base unit may be compact and easily transported in a storage position; however, the platform and the table when extended may provide an ample work surface at a traditional working height.

25 Claims, 25 Drawing Sheets

U.S. PATENT DOCUMENTS

| | | | | |
|---|---|---|---|---|
| 6,079,400 | A | 6/2000 | Dany | |
| 6,439,134 | B1 | 8/2002 | Ryburg | |
| 6,450,161 | B1 | 9/2002 | Izumi | |
| 6,464,098 | B1 | 10/2002 | Henson et al. | |
| 6,464,245 | B1 | 10/2002 | Miles | |
| 6,471,019 | B1 | 10/2002 | Miller | |
| 6,543,436 | B2 | 4/2003 | Montgomery | |
| 6,543,796 | B1 | 4/2003 | Johnson et al. | |
| 6,644,447 | B2 | 11/2003 | Pohl | |
| 6,763,769 | B2 * | 7/2004 | Ballendat | 108/79 |
| 7,168,372 | B2 * | 1/2007 | Fotia | 108/80 |
| 7,278,644 | B2 | 10/2007 | Villarreal | |
| 7,901,018 | B2 * | 3/2011 | Baughman | 190/117 |
| 2003/0132079 | A1 | 7/2003 | Bellini | |
| 2004/0045487 | A1 * | 3/2004 | Verkley | 108/77 |

* cited by examiner

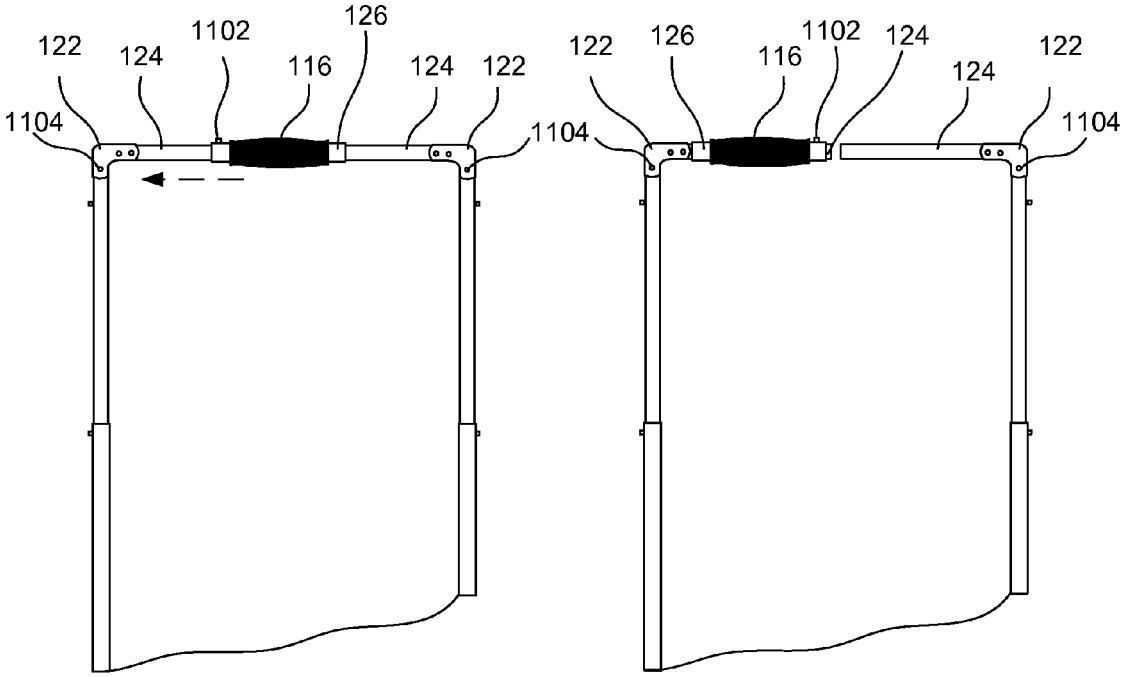
Fig. 11A
Fig. 11B
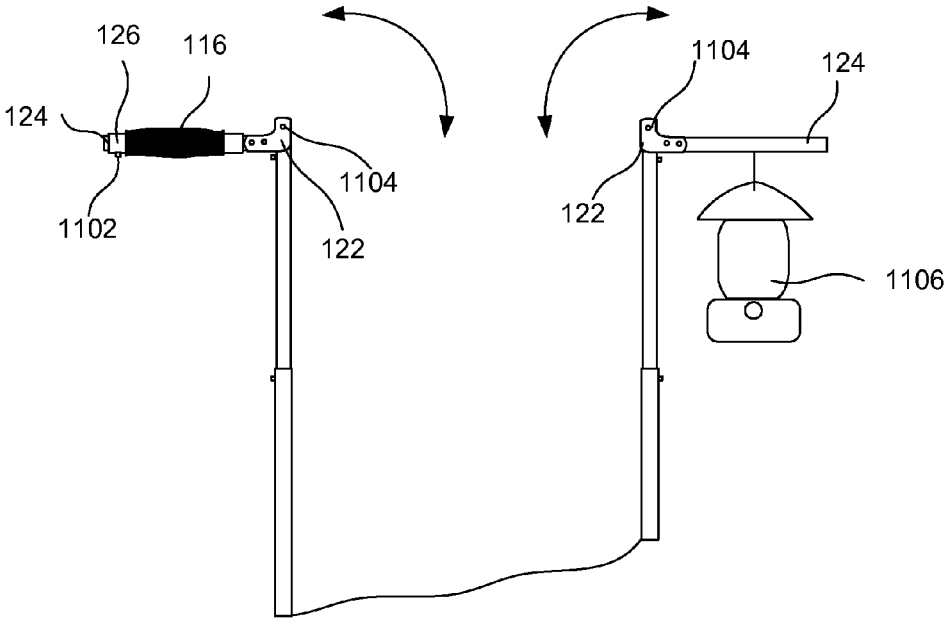
Fig. 11C

PORTABLE WORKSTATION

CROSS-REFERENCES TO RELATED APPLICATIONS

This application is a continuation-in-part of and claims priority to U.S. patent application Ser. No. 11/248,825 entitled "PORTABLE WORKSTATION" and filed on Oct. 12, 2005 now U.S. Pat. No. 7,901,018 for Joe Baughman which claims priority to U.S. Provisional patent application No. 60/618,428 entitled "KITCHEN PACK" and filed on Oct. 13, 2004 for Joe Baughman, both of the above referenced applications are incorporated herein by reference.

BACKGROUND OF THE INVENTION

1. Field of the Invention

This invention relates to portable work surfaces and more particularly relates to portable workstations that are lightweight and compact.

2. Description of the Related Art

Preparing food in a primitive environment can be a challenge for those people who normally prepare food in an organized kitchen. In an undeveloped area such as a campsite or lakeside, the user generally lacks a sturdy structure to organize kitchen items and to provide a sufficient working surface for preparing food and eating. Without a proper work surface, food can easily become soiled or contaminated and kitchen items can easily become excessively disorganized and unmanageable. In addition, packing utensils and cookware can also become a challenge, as many boxes or containers are typically required to pack a sufficient amount of cookware, cooking supplies, seasonings, pans, etc. Furthermore, the user may fail to pack all of the necessary provisions because of the difficult task of disemboweling a kitchen and then remembering what is needed and what has already been packed.

To facilitate the packing process, as well as to provide a temporary preparation area, several versions of a "camp kitchen" have been introduced into the market. The camp kitchens known in the art typically include a folding storage cabinet and commodities typically found in a kitchen environment, such as tables, drawers, stoves, storage compartments, sinks and the like. These camp kitchen, however, are generally heavy, bulky, and difficult to transport because they are often made of wood, steel, or other heavy materials to provide economy for this type of construction and to hold drawers, organizers, and the contents while traveling.

A common style of camp kitchen is a box style, which requires multiple rigid surfaces (top, bottom, sides) to maintain the container shape. The rigid surfaces of the container can only function in a limited way to provide work surfaces and other peripheral devices, such as tables, shelves, windscreens, etc. For example, the front of the box may function as a table, but since the rigid surface must hold the box together in a storage position, the rigid surface cannot fold or collapse for greater portability or to decrease the overall bulk. Thus, the size of the table is generally limited to the size of the box, which typically signifies providing a larger, bulkier box for sufficient work space. In a further example, the top or sides of the box may function as a windscreen; however, the rigid surfaces generally do not provide the lightest, most economical or most portable method of creating a windscreen.

Furthermore, items stored in a box style camp kitchen are typically difficult to access during transportation. Usually, the user must open the entire box to access the drawers and/or contents inside the box. In addition, the camp kitchens are often transported in a different orientation than the selected set up orientation, which may hinder user access during transport.

Typically, the camp kitchens require an additional stand that must be transported along with the camp kitchen in order to maintain the kitchen table(s) and/or surfaces at a useful working height. Because the camp kitchens must be stabilized from front to back, as well as side to side, the camp kitchens and the stands are inherently large and bulky, even though the stands may fold, scissor, etc. Bulky stands and bulky camp kitchens are usually difficult to transport and typically still provide limited work space.

From the foregoing discussion, it should be apparent that a need exists for an apparatus that provides an ample working surface and is compact, lightweight and easily transportable. Beneficially, such an apparatus, system, and method would further enable the user to pack and organize items in an accessible storage compartment. The apparatus would further provide the working surface at an appropriate height for the user without requiring an additional stand. Similarly, such an apparatus would provide lateral stability on uneven surfaces.

SUMMARY OF THE INVENTION

The present invention has been developed in response to the present state of the art, and in particular, in response to the problems and needs in the art that have not yet been fully solved by currently available portable workstations, particularly portable camp kitchens. Accordingly, the present invention has been developed to provide a lightweight, compact, portable workstation that overcomes many or all of the above-discussed shortcomings in the art.

The portable workstation, in one embodiment, includes a frame structure and a first table. The frame structure includes at least one vertical support member comprising substantially hollow tubing and at least two fins. A platform extends horizontally from the vertical support member and forms a top to the frame structure when the frame structure is positioned in an upright position. The first table comprises a support leg and is configured to extend from the frame structure and is configured to alternate between a first extended position and a storage position. When the table is in the extended position, the table provides support to the base unit of the workstation, forming an integrated tripod system. Thus, the base unit may be compact and easily transported in a storage position; however, the platform and the table when extended may provide an ample work surface at a traditional working height. The base unit may include a frame structure and may be transported on wheels or carried like a back pack in certain embodiments.

The workstation, in one embodiment, further comprises a first support leg configured to telescopically extend laterally from the frame structure. The first support leg provides an additional lateral support for maintaining the apparatus in an upright position. In certain embodiments a second support leg is configured to nest with the first support leg, the second support leg is further configured to provide elevational support to the frame structure to maintain the frame structure a predetermined distance above the ground.

In an embodiment the workstation further comprises at least one handle support and a handle with the at least one handle support slideably received within an additional vertical support member. The handle support is configured to telescopically extend from the additional vertical support member.

In certain embodiments the workstation further comprises an additional handle support slideably received within an additional vertical support member and configured to telescopically extend for the additional vertical support member. The handle comprises a first shaft rotatably coupled to the at least one handle support and a second shaft rotatably coupled to the additional handle support. The first shaft and the second shaft are configured to rotate from an inward position to an outward position. A slideable sleeve is configured to detachably couple the first shaft and the second shaft.

In an embodiment a bar is removeably attached to the at least one handle support and the additional handle support. The bar is configured to support a hanging bag. The hanging bag may hold spices, utensils or other items for use with the portable workstation.

In certain embodiments a second table is configured to extend from the first table. The second table is configured to alternate between an extended position and a storage position. The second table provides additional workspace for a user using the portable workstation.

In an embodiment the first table is coupled to the frame structure by a double hinge. The double hinge comprises a first pivot point disposed substantially above a second pivot point. In certain embodiments a workstation using a double hinge allows a longer table than a workstation using a single hinge.

In one embodiment, the workstation includes a base unit comprising at least one vertical support member a first table and a first support leg. The first table is connected to the top of the base unit and is configured to alternate between an extended position and a storage position. The first support leg is configured to telescopically extend laterally from the frame structure to provide lateral support for maintaining the apparatus in an upright position.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

The features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which:

FIG. 11A is a front view illustrating one embodiment of a handle disposed in an inward position in accordance with the present invention.

FIG. 11B is a front view illustrating one embodiment of the handle of FIG. 11A slid to one side over a handle shaft in accordance with the present invention.

FIG. 11C is a front view illustrating one embodiment of the handle of FIG. 11A and FIG. 11B with handle shafts rotated to outward position in accordance with the present invention.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to give a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
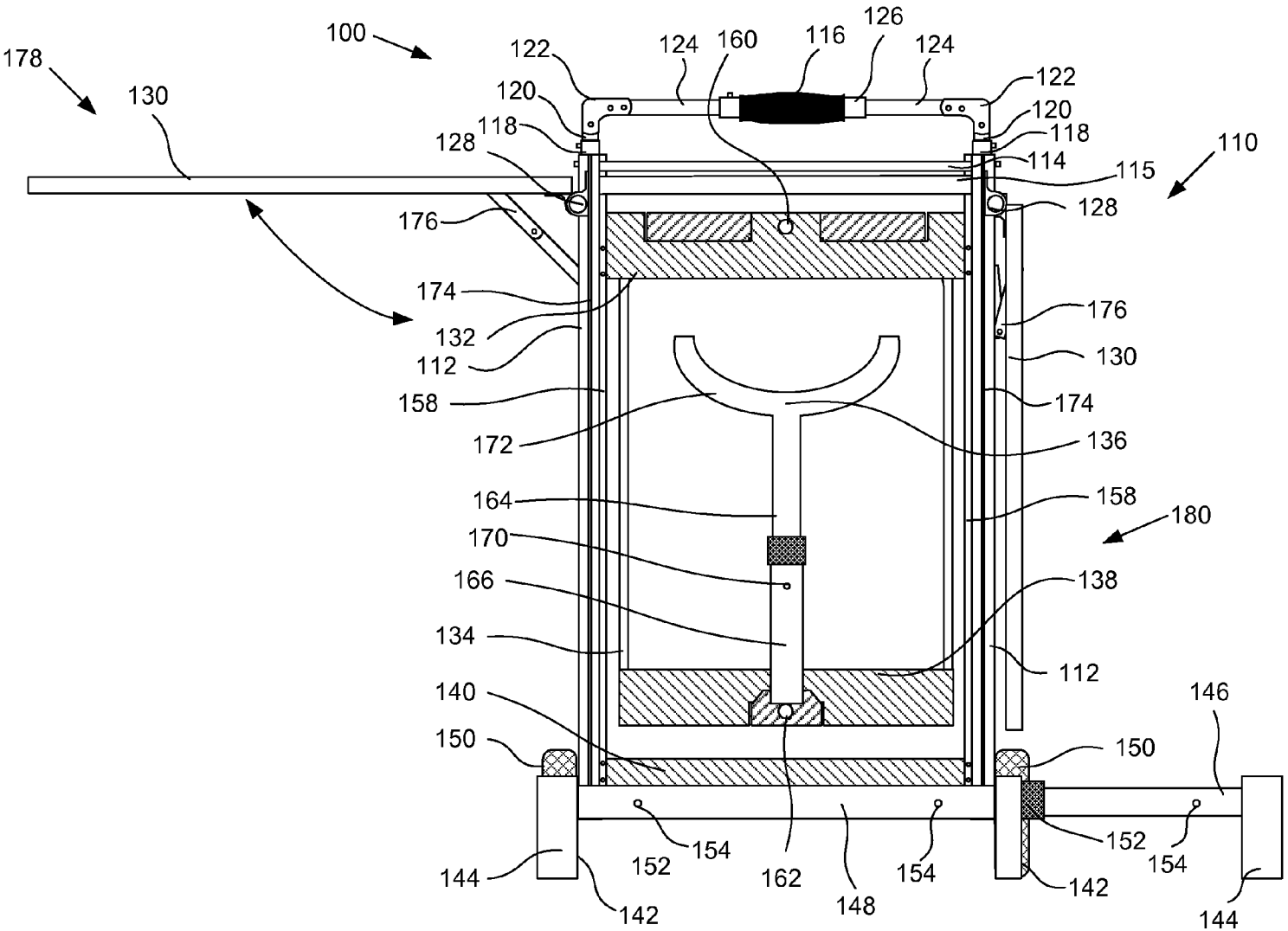
FIG. 1 is a front view illustrating one embodiment of the frame structure of a portable workstation in accordance with the present invention.

FIG. 1 depicts one embodiment of a portable workstation 100 in accordance with the present invention. The portable workstation 100, as depicted, includes a frame structure 110 comprising, vertical support members 112, a platform 114, a bag attachment rod 115, a handle 116, additional vertical support members 118, telescoping handle support members 120, handle hinges 122, handle shafts 124, a slideable sleeve 126, side table hinges 128, side table support frames 130, a rear table hinge 132, a rear table support frame 134, rear table support leg 136, rear table support leg hinge 138, axle support member 140, inner support legs 142, outer support legs 144, support leg shaft 146 and a support leg tube 148. The portable workstation 100 may include wheels 150 which may operate in association with handle 116 to facilitate transporting the portable workstation 100 similar to wheeled luggage. The wheels 150 may be attached to the frame structure 110 to mobilize the workstation 100 for easy transportation of stored items.

The frame structure 110, in the depicted embodiment, may remain in a substantially upright position while stationary and during transport. The inner support legs 142 provide support to the front of the frame structure 110. The outer support legs 144 may be affixed to a telescoping support leg shaft 146. While the illustrated embodiments depict two legs for each side of the frame structure 110, one skilled in the art will recognize that in certain embodiments the apparatus may comprise a single stationary support leg. Additionally, in certain embodiments a single telescoping support leg may be disposed on each side of the frame structure and may be configured to laterally slide away from the frame structure 110 to provide lateral support to the frame structure. The support leg shaft 146 is slideably received within support leg tube such that the support leg shaft 146 and outer support leg 144 may be telescopically extended to the side of the frame structure 110 to provide lateral support to the frame structure 110. A compression nut 152 is threadedly affixed to each end of the support leg tube 148 and configured to compress the support leg tube 148 around the support leg shaft 146 such that vertical movement of the support leg shaft 146 is restricted. Thus, when the compression nut 152 is tightened around the support leg tube 148, solid lateral support is maintained for the frame structure 110.

Figure 2A:
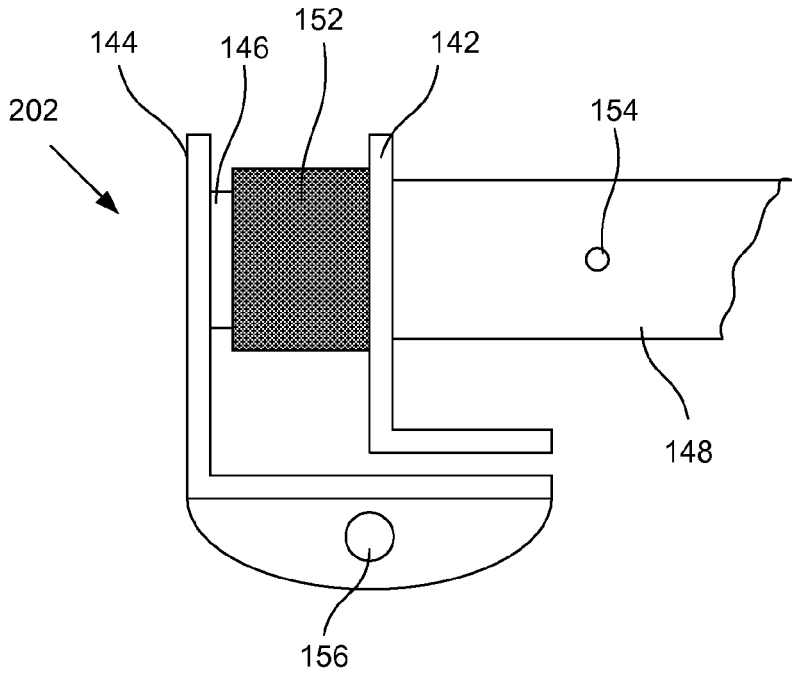
FIG. 2A is front view illustrating one embodiment of the inner and outer support legs in a nestled configuration in accordance with the present invention.
Figure 2B:
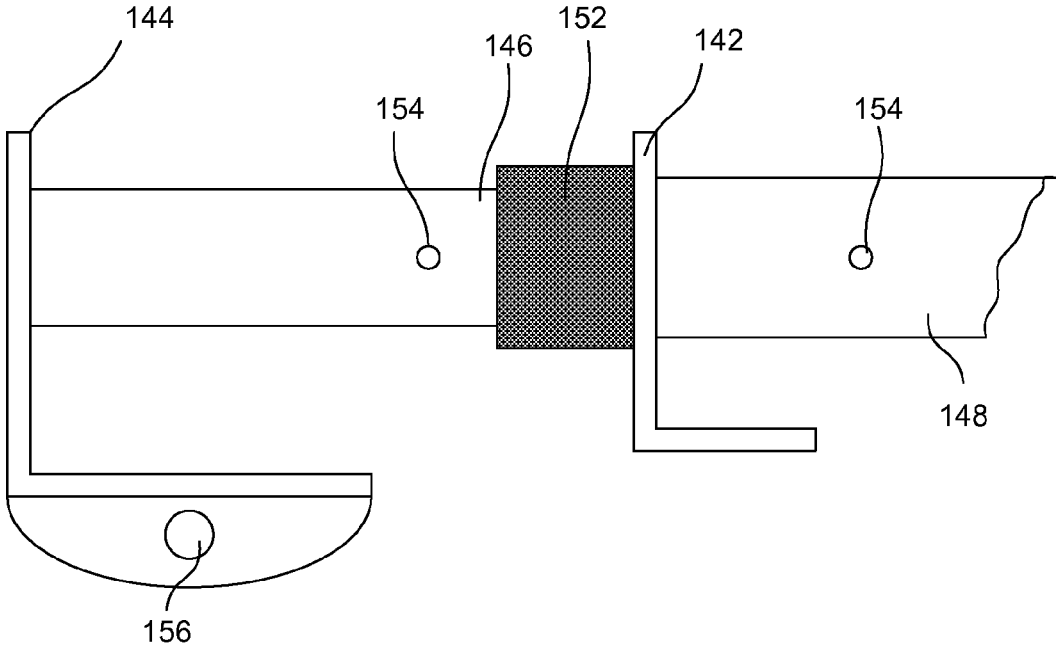
FIG. 2B is front view illustrating one embodiment of the inner and outer support legs in an extended configuration in accordance with the present invention.

In certain embodiments, such as the embodiments shown in FIG. 2A and FIG. 2B, the inner support legs 142 and the outer support legs 144 comprise an "L" shaped structures when viewing the apparatus from above. Push buttons 154 may be configured such that outer support leg 144 can be locked in two positions. In the first position 202 shown in FIG. 2A the outer support leg 144 is nested with the inner support leg 142. Push button 154 restricts lateral movement of the support leg shaft 146. The outer support leg 144 may be laterally extended to the position shown in FIG. 2B by depressing the push button 154 and sliding the support leg shaft 146 out of the support leg tube 148. In certain embodiments an additional push button 154 is be provided to lock the outer support leg 144 in a second position as shown in FIG. 2B. In certain embodiments a stake hole 156 may be provided in the support legs through which a stake (not shown) may be driven to provide added stability. In the embodiments illustrated in FIG. 2A and FIG. 2B a compression nut 152 is positioned to provide solid lateral support to the support leg shaft 146.

Figure 2C:
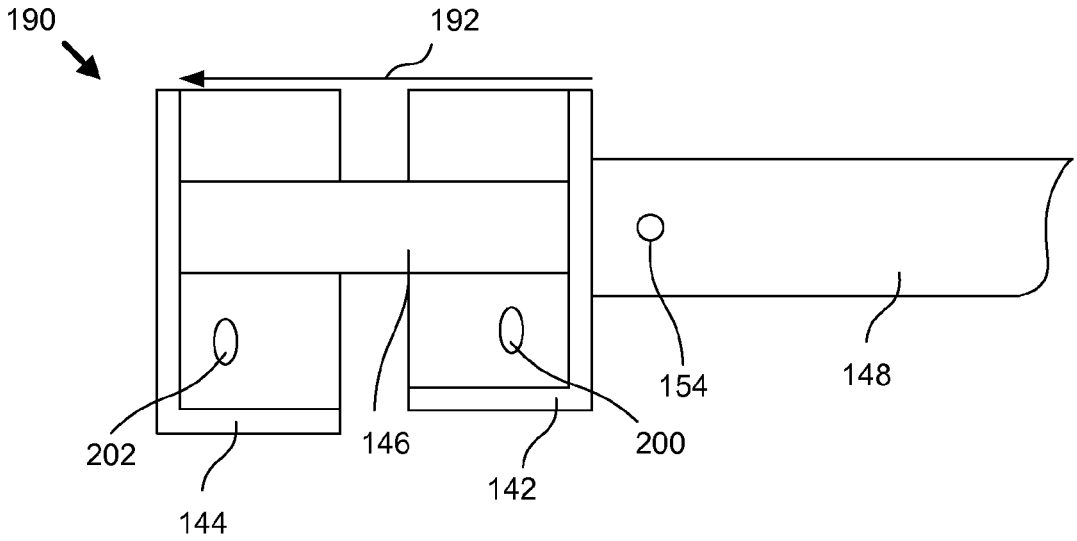
FIG. 2C is top view illustrating one embodiment of the inner and outer support legs in an extended configuration in accordance with the present invention.
Figure 2D:
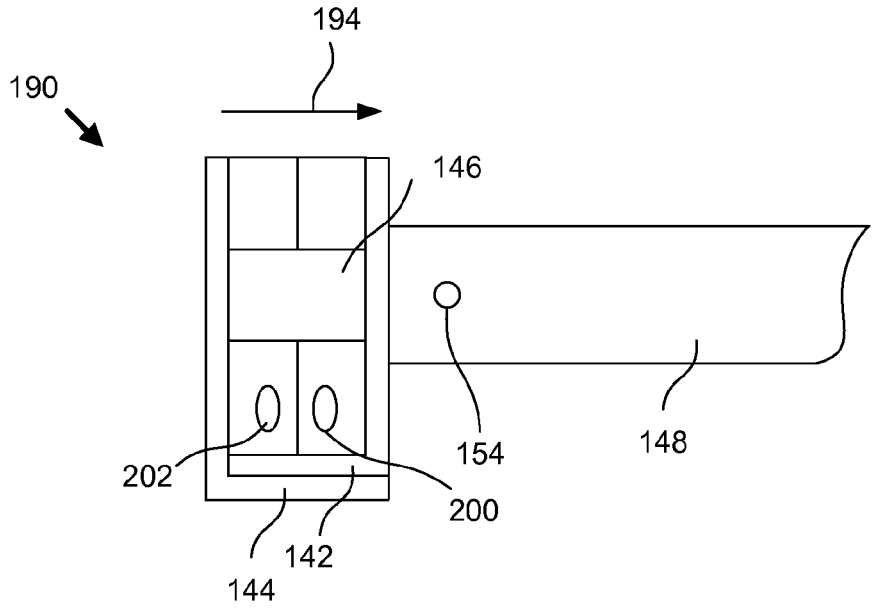
FIG. 2D is top view illustrating one embodiment of the inner and outer support legs in a nestled configuration in accordance with the present invention.

FIG. 2C illustrates a top view of an embodiment of the inner and outer support leg assembly 190 in which the support leg shaft 146 is slideably received within the support leg tube 148 such that the support leg shaft 146 can be withdrawn from the support leg tube 148 in the direction indicated by arrow 192. One skilled in the art will recognize that the support leg shaft 146 can also be received within the support leg tube 148 in the direction of arrow 194 such that the inner support leg 142 and the outer support leg 144 nestle together as illustrated in FIG. 2D. In certain embodiments the inner support leg 142 is slightly larger than the outer support leg 144 such that the outer support leg 144 nestles within the inner support leg 142. When the inner support leg 142 is nestled with the outer support leg 144 both feet provide support to the frame structure 110 when the portable work station 100 is dropped on one support leg assembly 190. In certain embodiments the inner support leg 142 is permanently affixed to the support leg tube 148 and provides the main elevational support to the frame structure 110. In one embodiment the outer support leg 144 provides lateral support to the frame structure 110 to maintain the portable workstation 100 in an upright position. In use, stakes (not show) may be driven through stake hole 200 disposed within the inner support leg 142 and stake hole 202 disposed within the outer support leg 144 to hold the frame structure in one place.

A push button 154 may be disposed on the top of support leg tube 148 and may operate to restrict lateral motion of the support leg shaft 146 at predetermined positions such as when the support leg shaft 146 is fully extended and/or when the support leg shaft 146 is fully inserted into support leg tube 148. In certain embodiments additional push buttons 154 may be disposed along the length of support leg shaft 146 to provide a variety of locking positions for support leg shaft 146. One skilled in the art will recognize that the push button 154 may operate on the front or back of support leg tube 148 rather than the top of the support leg tube 148. Similarly, one skilled in the art will recognize that a plurality of push buttons 154 may be provided to add additional support to the support leg shaft 146.

Figure 2E:
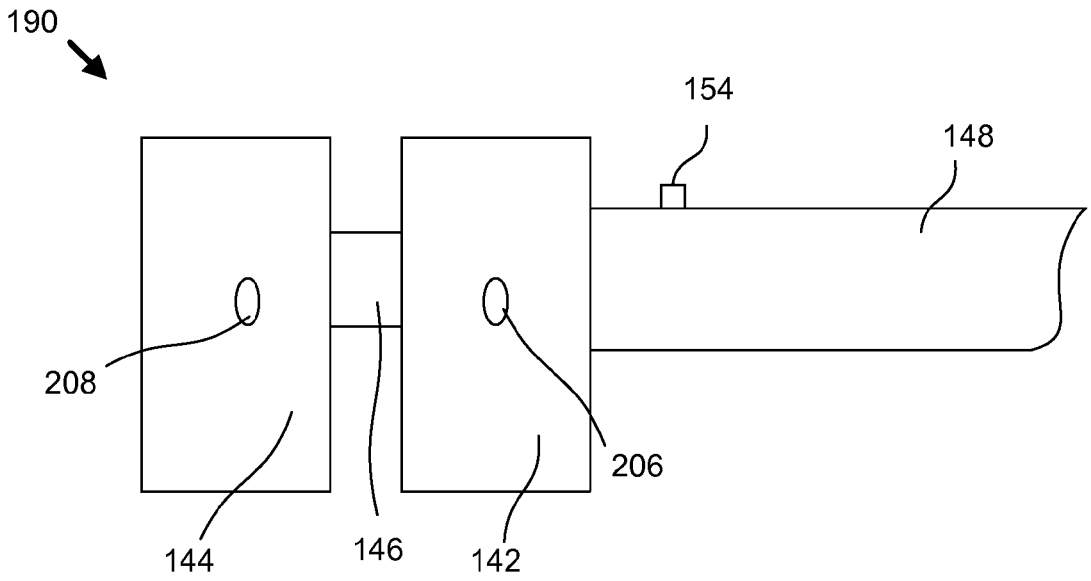
FIG. 2E is front view illustrating one embodiment of the inner and outer support legs in a partially extended configuration in accordance with the present invention.
Figure 2F:
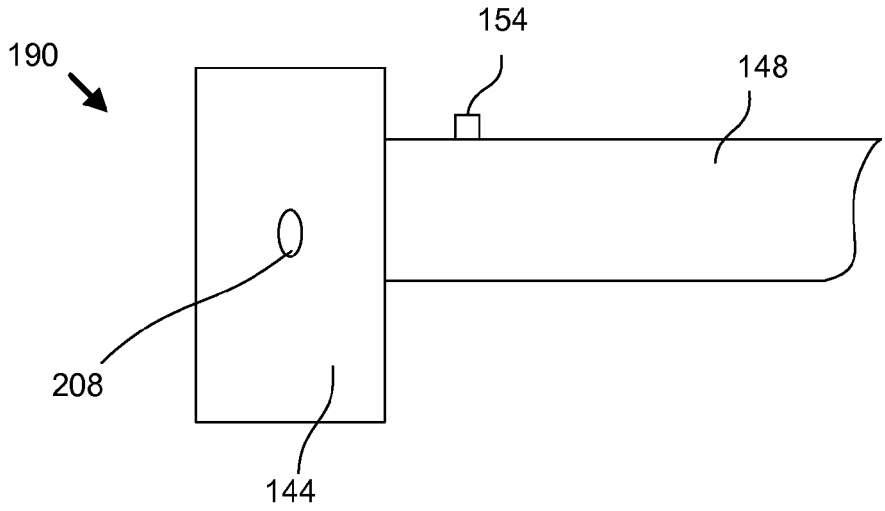
FIG. 2F is front view illustrating one embodiment of the inner and outer support legs in a nestled configuration in accordance with the present invention.

FIG. 2E and FIG. 2F illustrate a front view of one embodiment of the inner and outer support leg assembly 190. FIG. 2E illustrates the inner and outer support leg assembly 190 in a partially extended position similar to the embodiment illustrated in FIG. 2C. FIG. 2F illustrated the inner and outer support leg assembly 190 in a withdrawn position with the inner support leg 142 nestled with the outer support leg 144 similar to the embodiment illustrated in FIG. 2D. In certain embodiments a stake hole 208 is disposed through the front surface of the outer support leg 144. Similarly, in certain embodiments a stake hole 206 is disposed through the front surface of the inner support leg 142. The stake hole 208 and the stake hole 206 may communicate with stake holes 202 and 200 respectively to allow a stake to be driven through both stake holes to keep the portable workstation 100 in place.

Figure 2G:
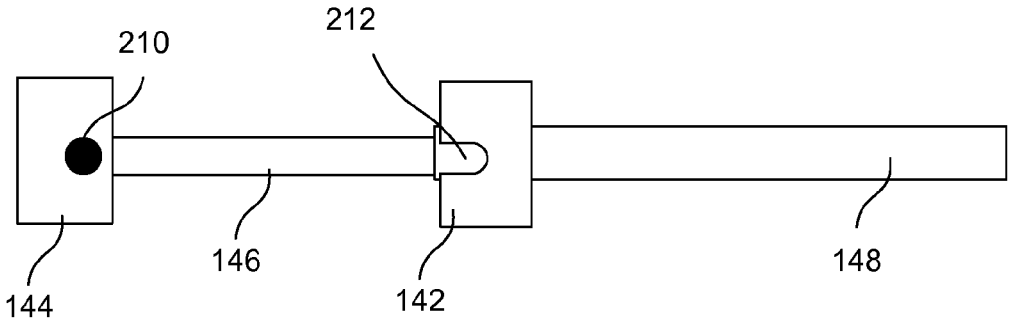
FIG. 2G is a bottom view illustrating one embodiment of the inner and outer support legs in a partially extended configuration in accordance with the present invention.
Figure 2H:
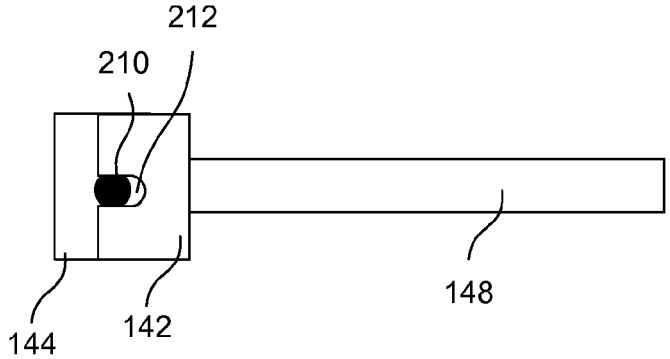
FIG. 2H is a bottom view illustrating one embodiment of the inner and outer support legs in a nestled configuration in accordance with the present invention.
Figure 2I:
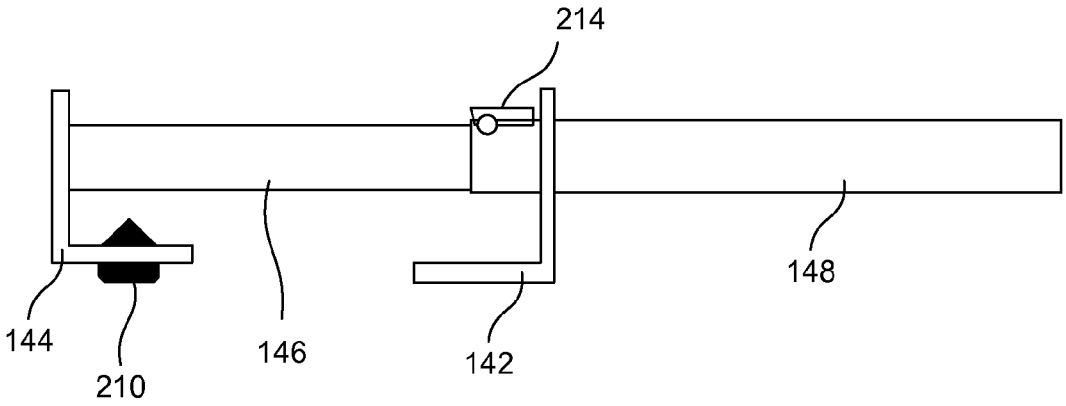
FIG. 2I is a side view illustrating one embodiment of the inner and outer support legs in a partially extended configuration with a knob supporting the outer leg in accordance with the present invention.

FIG. 2G illustrates a bottom view of an inner support leg 142 and an outer support leg 144 in an extended position according to one embodiment of the current invention. In certain embodiments the outer support leg 144 is configured to nest within the inner support leg 142 as shown in FIG. 2H. One skilled in the art will recognize that in certain embodiments, not shown, the inner support leg 142 may be configured to nest within the outer support leg 144. Because one of the support legs 142 or 144 nests within the other support leg, one of the support legs will be disposed at a higher position than the other support leg as shown in FIG. 2I. In FIG. 2I the outer support leg 144 is disposed on a higher plane than the inner support leg 142. To compensate for the difference in height a knob 210 may be disposed within the outer support leg 144. A notch 212 may be disposed in the inner support leg 142 to accommodate the knob 210 when the outer support leg 144 is nested within the inner support leg 142. On skilled in the art will recognize that the opposite configuration may be arranged without departing from the scope of the current invention.

In certain embodiments a cam device 214 may be configured to lock the support leg shaft 146 in a lateral position relative the support leg tube 148. Thus, where a cam device 214 is used, the support leg shaft 146 may be micro adjusted to an infinite number of lateral locations with respect to the support leg tube 148.

Figure 2J:
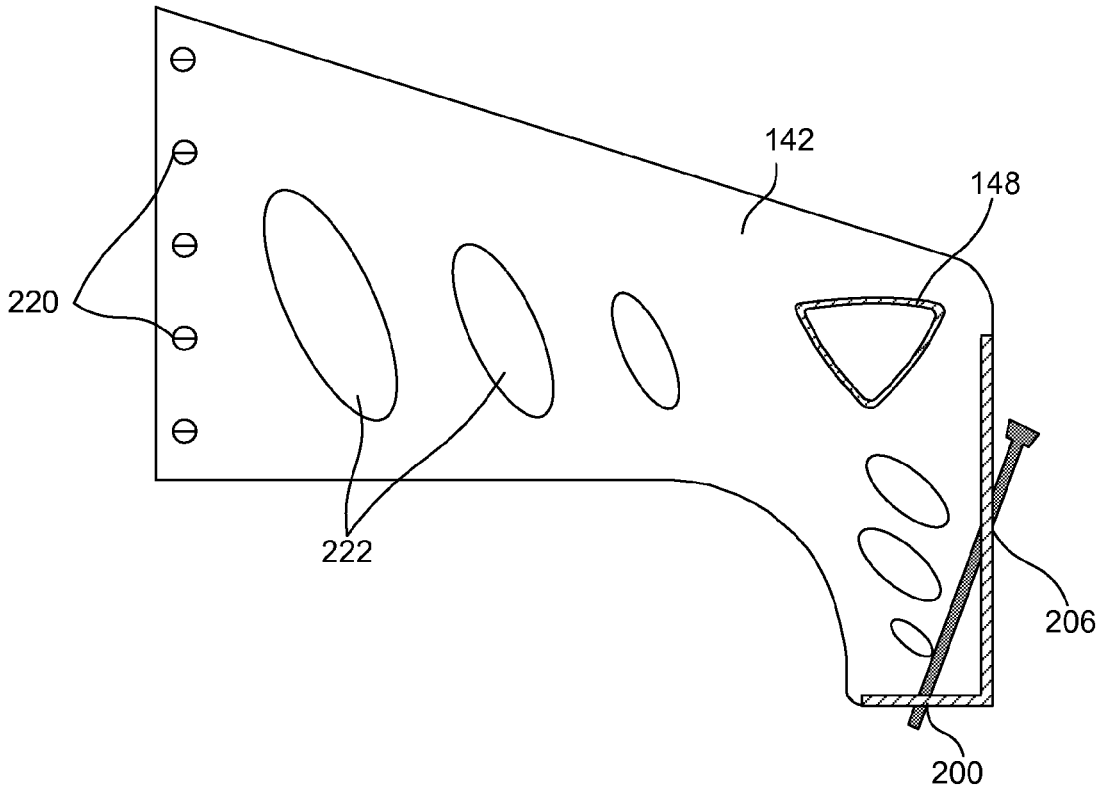
FIG. 2J is a side view illustrating one embodiment of an inner support leg in accordance with the present invention.

FIG. 2J illustrates a side view of an inner support leg 142 according to one embodiment of the current invention. In certain embodiments the inner support leg 142 is attached to the vertical support members 112 of the frame structure 110 by means of a plurality of screws 220. As discussed above with reference to FIGS. 2C-2F, in certain embodiments a stake 222 may be driven through stake holes 206 and 200 in the inner support leg 142 to secure the portable work station 100 to the ground. To reduce weight a plurality of holes 222 may be disposed within the inner support leg 142.

Figure 2K:
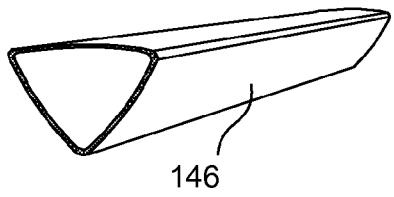
FIG. 2K is a perspective view illustrating one embodiment of a triangular support leg shaft in accordance with the present invention.

In certain embodiments, such as the embodiment illustrated in FIG. 2J, the support leg tube 148 may be triangular. The support leg shaft 146 may likewise be triangular such as in the embodiment illustrated in FIG. 2K. A triangular support leg shaft 146, when inserted into a triangular support leg tube 148 will ensure that the outer support leg 144 is aligned with the inner support leg 142. On skilled in the art will recognize that that the support leg shaft 146 and the support leg tube 148 may comprise other profile shapes which will maintain the outer support leg 144 in alignment with the inner support leg 142.

Figure 2L:
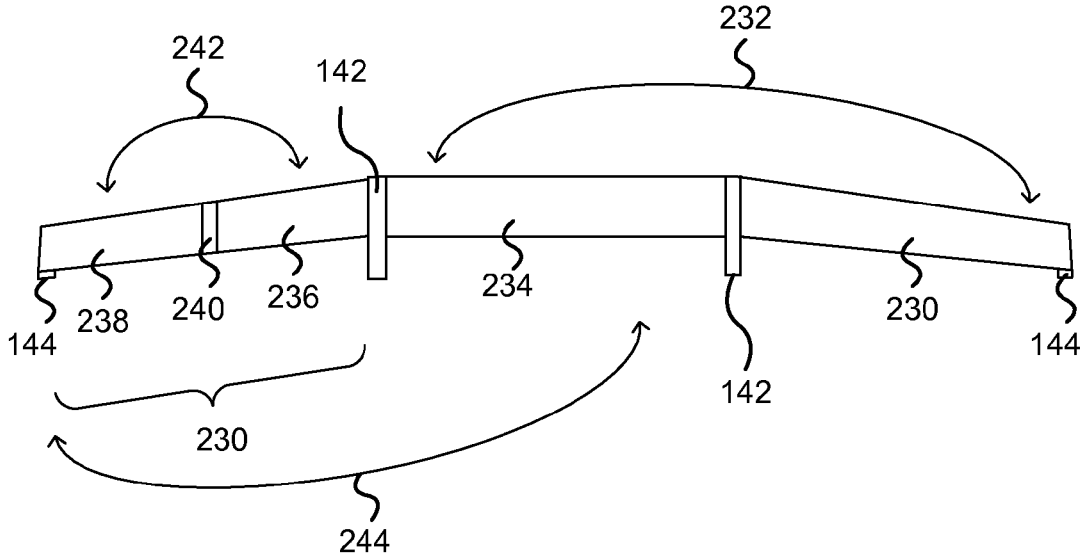
FIG. 2L is a front view illustrating one embodiment of a folding leg assembly in accordance with the present invention.

In one embodiment, such as the embodiment illustrated in FIG. 2L, the outer support legs 144 are attached to a support wing 230. The support wing 230 is configured to pivot about the inner support legs 142 in the direction indicated by arrow 232 such that the support wing 230 may be positioned in a first closed position with the support wing 230 lying flat against a front leg support member 234 and a second open position with the support wing 230 extended away from the front leg support member 234. In one embodiment the support wing 230 may comprise an inner support wing section 236 and an outer support wing section 238. A pivot mechanism 240 may be disposed between the inner support wing section 236 and the outer support wing section 238 such that the outer support wing section 238 can pivot in the direction indicated by arrow 242 to lie flat against the inner support wing section 236. The entire support wing 230 may then pivot around the inner support leg 142 in the direction indicated by arrow 244 to lie flat against the front leg support member 234. Thus, in certain embodiments the outer support leg 144 is configured to pivot around the inner support leg 142 to extend laterally from the frame structure 110 to provide lateral support for maintaining the portable workstation 100 in an upright position. While the embodiment illustrated in FIG. 2L shows a different left and right support wing structure, one skilled in the art will recognize that either support wing structure may be utilized for both support wings.

Referring again to FIG. 1, in certain embodiments, an axle support member 140 may be connected to vertical support members 112 at the bottom of the frame structure 110. The axle support member 140 spaces the bottom of the vertical support members 112 a predetermined distance apart. The axle support member may be attached to a fin 158 disposed on the vertical support member 112 using rivets, a nut and bolt, a self tapping screw or other fastening devices as is known in the art. In certain embodiments the axle support member 140 may be welded to the fin 158. The axle support member is further described below in reference to FIG. 4A and FIG. 4B. A rear table hinge 132 provides support to the top of the vertical support members 112 and spaces the top of the vertical support members 112 substantially the same distance apart as the bottom of the vertical support members 112. The rear table hinge 132 is described in further detail below in reference to FIG. 5. The rear table hinge 132 may be attached to the fin 158 using rivets, a nut and bolt, a self tapping screw or other fastening devices as is known in the art. In certain embodiments the rear table hinge 132 may be welded to the fin 158.

A rear table support frame 134 is attached to the rear table hinge 132 such that the rear table support frame 134 may pivot between a plurality of positions including an extended position in which the rear table support frame 134 extends at a ninety degree angle in relation to the frame structure 110 and a storage position in which the rear table support frame 134 is disposed parallel to the frame structure 110. A rear table hinge locking pin hole 160 may be disposed in the rear table hinge 132. A locking pin (not shown) may be removeably positioned within a rear table hinge locking pin hole 160 to lock the rear table support frame 134 in the extended position. One skilled in the art will recognize that in certain situations, such as where the portable workstation 100 is place on uneven ground, it may be desirable to remove the rear table to achieve a stable footing. Therefore, in certain embodiments the rear table support frame 134 may be removeably attached to the frame structure 110 such that the rear table (described in more detail with reference to FIG. 15 below) as well as the rear table support frame 134 may be removed from the frame structure for transport or storage or to achieve a stable footing for the frame structure 110.

A rear table support leg 136 is pivotably attached to the rear table support frame 134 by a rear table support leg hinge 138. The rear table support leg 136 may pivot between a plurality of positions including an extended position in which the rear table support leg 136 is disposed in a ninety degree angle in relation to the rear table support frame 134. A locking pin (not shown) may be removeably positioned within a rear table support leg hinge locking pin hole 162 to lock the rear table support leg in an extended position.

The rear table support leg 136 may comprise a lower rear table support leg shaft 164 slideably received within an upper rear table support leg tube 166. The lower rear table support leg shaft 164 may be connected to a "U" shaped rear table foot 172 which provides two contact points with the ground when the rear table support leg 136 is extended. In other embodiments the rear table support leg shaft 164 may extend all the way to the ground when the rear table support leg 136 is extended. In certain embodiments a compression nut 168 may be threadedly disposed on the upper rear table support leg tube 166 and configured to compress the upper rear table support leg tube 166 around the lower rear table support leg shaft 164 such that movement of the lower rear table support leg shaft 164 is restricted. A push button 170 may be disposed on the lower rear table support leg shaft 164, the push button is configured to restrict the lower rear table support leg shaft 164 from sliding in or out of the upper rear table support leg tube 166 without depressing the push button 170.

Side table support frames 130 are pivotably attached to the frame structure 110 by side table hinges 128 which allow the side table support frames 130 to be positioned in a plurality of positions including a first extended position 178 in which the side table support frames 130 are extended ninety degrees in relation to the vertical support members 112. In a second storage position 180 the side table support frame may be positioned adjacent to and parallel with the vertical support members 112. The side table hinges 128 are attached to front fins 174 on the vertical support vertical support members 112. A strap hinge 176 may be attached to the side table support frame 130 at one end and a vertical support member 112 at the other end. Thus, when the side table support frame 130 is placed in the first extended position 178, the strap hinge 176 locks the side table support frame 130 in a horizontal plane. When the side table frames are placed in the second storage position 180, the strap hinge 176 folds in on itself to allow the side table support frame to lie parallel to the vertical support members 112.

A platform 114 may extend horizontally from vertical support members 112 to form a top to the frame structure 110 when the frame structure is placed in an upright position. The platform 114 may comprise a metallic or heat resistant material such that a stove (not pictured) may be placed on the platform 114. The platform may be attached to fins 158 or front fin 174 or both.

As further described below, a handle 116 may be telescopically connected to the main frame structure 110 by additional vertical support members 118 slideably received within vertical support members 112. The handle 116 may cover a slideable sleeve 126 configured to slide back and forth on handle shafts 124. Handle shafts 124 may be pivotably connected to telescoping handle support members 120 by handle hinges 122. The handle 116 may comprise foam or other soft material for comfort when transporting the portable workstation 100.

Figure 3:
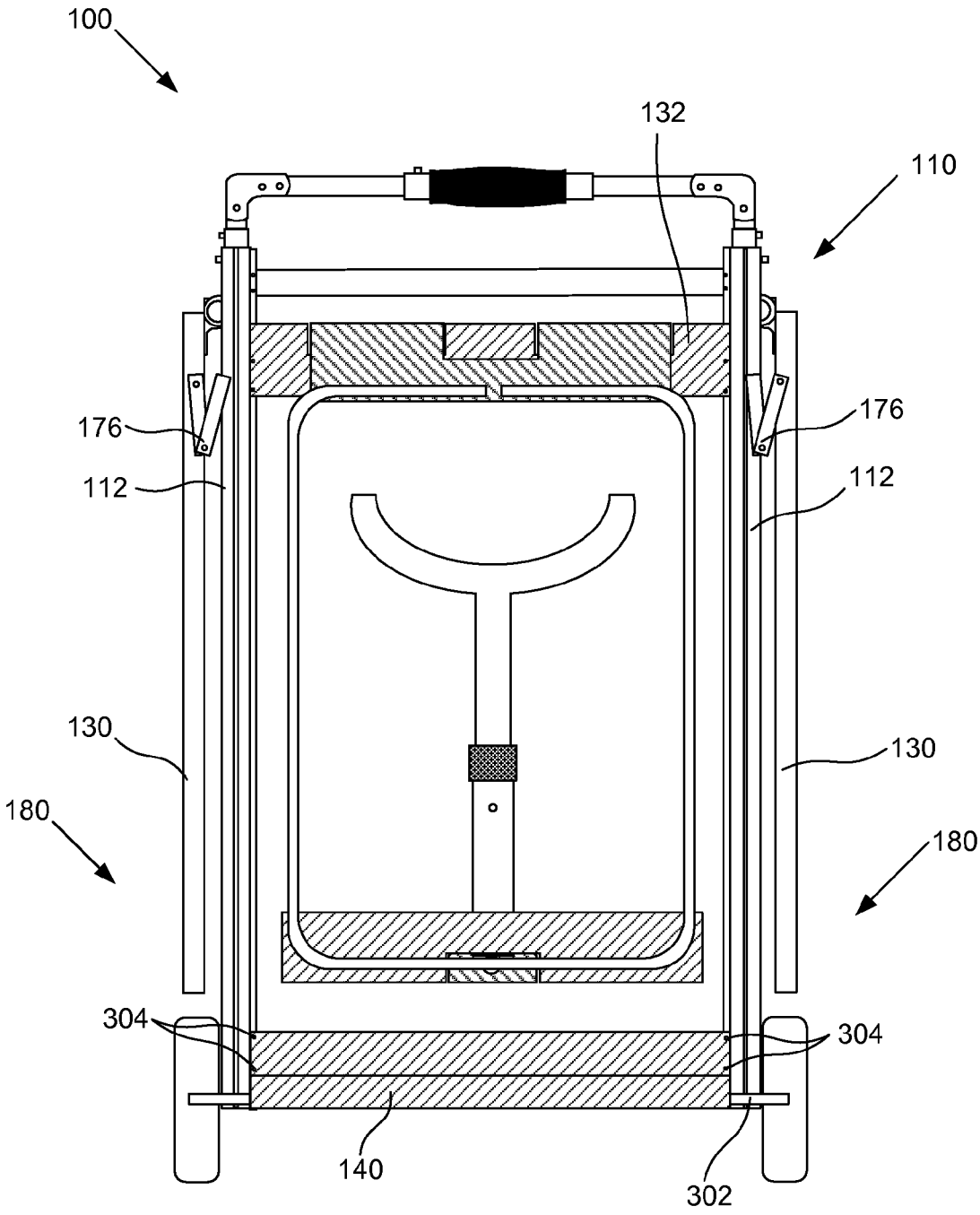
FIG. 3 is a rear view illustrating one embodiment of the frame structure of a portable workstation in accordance with the present invention.

FIG. 3 illustrates a rear view of the frame structure 110 of the portable workstation 100. In the embodiment illustrated in FIG. 3, both side table support frames 130 are placed in the second storage position 180 such that the side table support frames 130 are parallel to the vertical support members 112. To place the side table support frames 130 in the second storage position 180, strap hinges 176 are folded in on themselves.

Figure 4A:
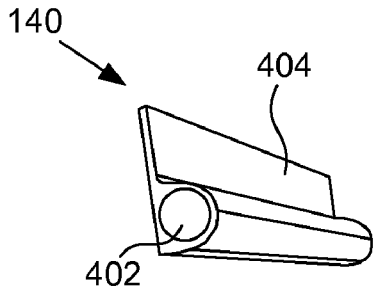
FIG. 4A is a perspective view illustrating one embodiment of an axle support member extrusion in accordance with the present invention.
Figure 4B:
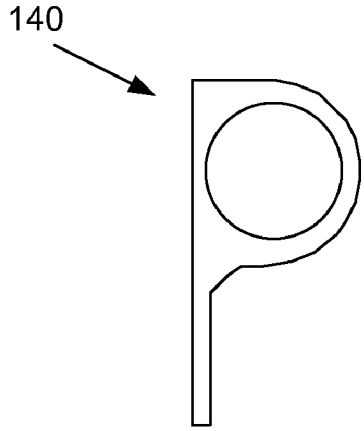
FIG. 4B is a profile view illustrated one embodiment of the axle support member extrusion in accordance with the present invention.

In certain embodiments, such as the embodiment illustrated in FIG. 4A, the axle support member 140 may comprise a hollow void 402 and a flat portion 404. Referring again to FIG. 3, an axle 302 may run through the hollow void 402 in axle support member 140. The axle support member 140 may be connected to the vertical support members 112 by rivets 304. In certain embodiments the axle support member 140 may be welded to the vertical support members 112 or may be attached by other suitable means as is known to one skilled in the art. The axle support member 140 may comprise a material extruded in substantially the form shown in FIG. 4A. A cross section of the axle support member 140 is shown in FIG. 4B. One skilled in the art will recognize that the extrusions described herein may comprise one or more of a metal, plastic or composite material.

Figure 5:
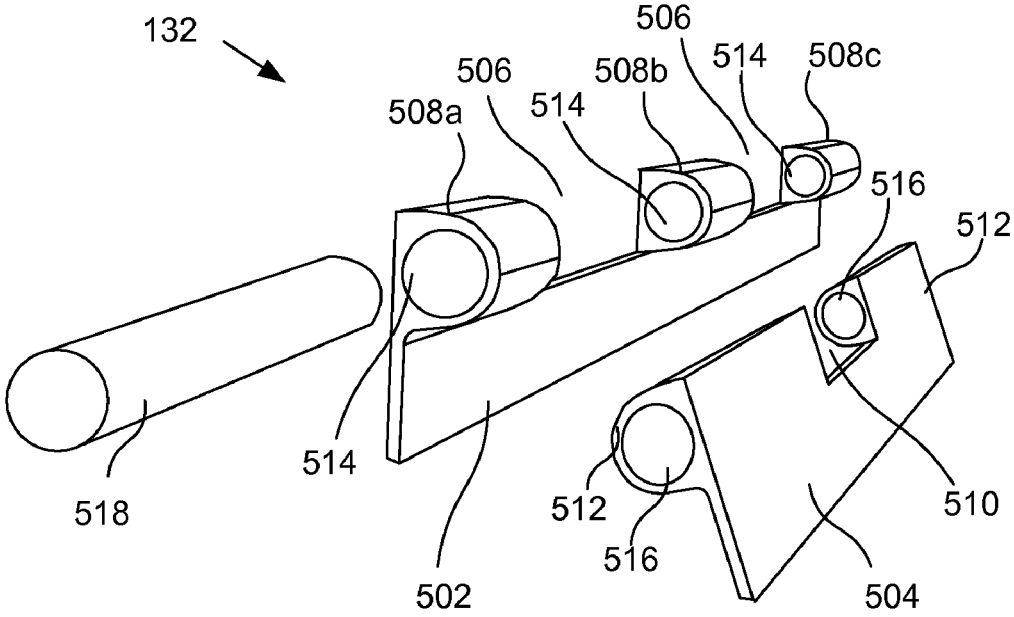
FIG. 5 is a perspective view illustrating one embodiment of a rear table hinge in accordance with the present invention.

FIG. 5 illustrates one embodiment of rear table hinge 132 in which the rear table hinge 132 comprises a vertical support member mounting portion 502 and a rear table frame structure mounting portion 504. The two portions of the rear table hinge 132 may comprise a material extruded substantially in the form shown in FIG. 4A and the cross section shown in FIG. 4B. In certain embodiments the vertical support member mounting portion 502 and the rear table frame structure mounting portion 504 are constructed in the same manner as the axle support member 140. Thus, the same extruded material may be used to form the axle support member 140, the vertical support member mounting portion 502 and the rear table frame structure mounting portion 504 of the rear table hinge 132. This eliminates the necessity of multiple extrusions.

To form the vertical support member mounting portion 502 of the rear table hinge 132 notches 506 are removed from an extrusion such as the extrusion used as the axle support member illustrated in FIG. 4A leaving hinge lobes 508. To form the rear table frame structure mounting portion 504 of the rear table hinge 132 notch 510 is removed from an extrusion such as the extrusion used as the axle support member illustrated in FIG. 4A leaving hinge lobes 512. The notches 506 in the vertical support member mounting portion 502 of the rear table hinge 132 are slightly larger than the hinge lobes 512 of the rear table frame structure mounting portion 504 of the rear table hinge 132. The notch 510 of the rear table frame structure mounting portion 504 of the rear table hinge 132 is slightly larger than the middle hinge lobe 508*b* of the vertical support member mounting portion 502 of the rear table hinge 132. Thus, the vertical support member mounting portion 502 may be placed in a mating relationship with the rear table frame structure mounting portion 504. When the vertical support member mounting portion 502 and the rear table frame structure mounting portion 504 are aligned, hollow voids 514 on the vertical support member mounting portion 502 align with hollow voids 516 on the rear table frame structure mounting portion 504. When hollow voids 514 are aligned with hollow voids 516, a hinge shaft 518 may be positioned within the hollow voids. In this manner, the rear table frame structure mounting portion 504 of the rear table hinge 132 pivots around the hinge shaft 518. Because the rear table support frame 134 is attached to the rear table frame structure mounting portion 504 of the rear table hinge 132, the rear table support frame 134 can pivot between an extended position in which the rear table support frame 134 is extended ninety degrees in relation to the vertical support members 112 and a storage position in which the rear table support frame 134 lies parallel and adjacent to the vertical support members 112.

Figure 6:
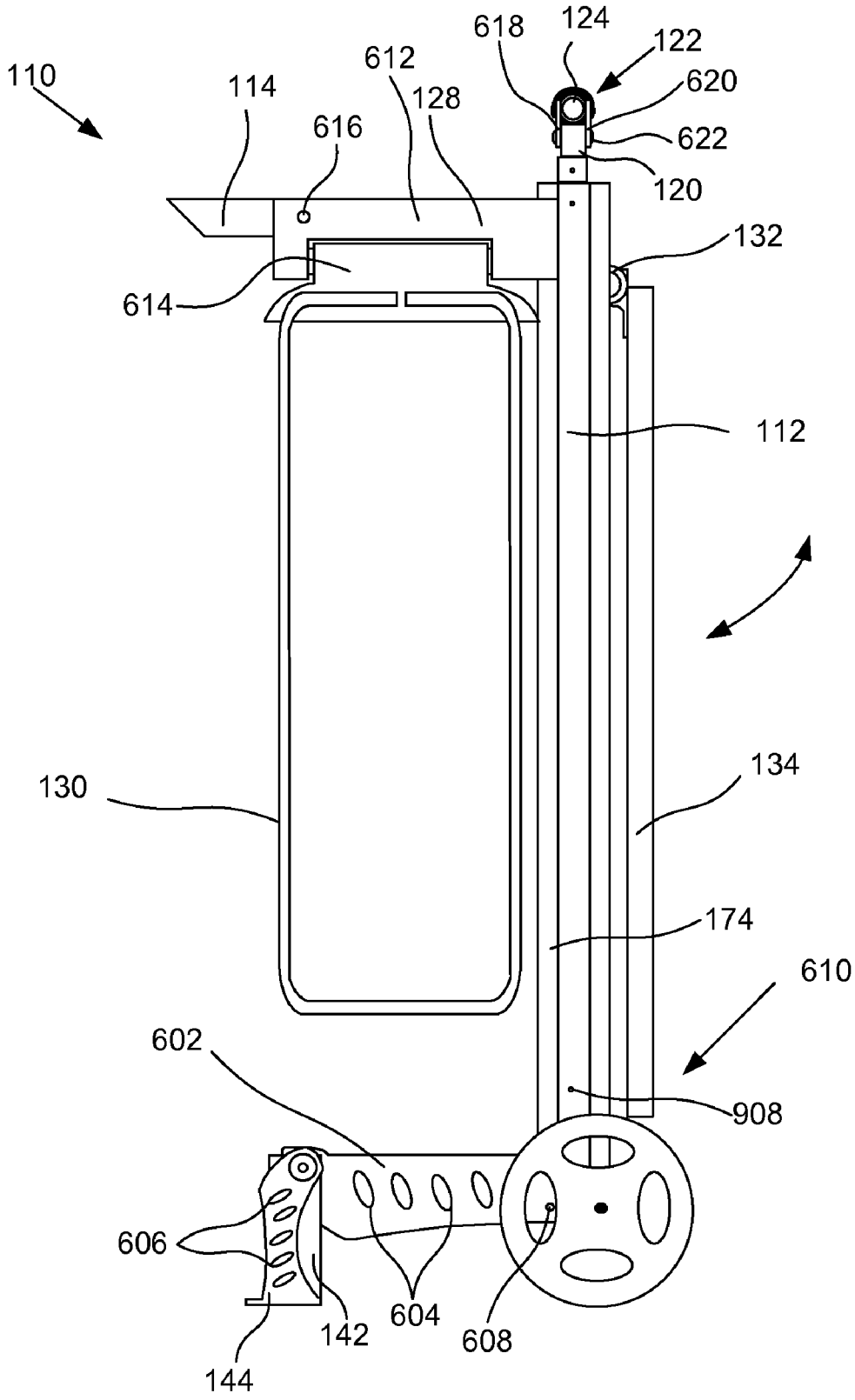
FIG. 6 is a side view illustrating one embodiment of a frame structure of a portable workstation in accordance with the present invention.
Figure 7:
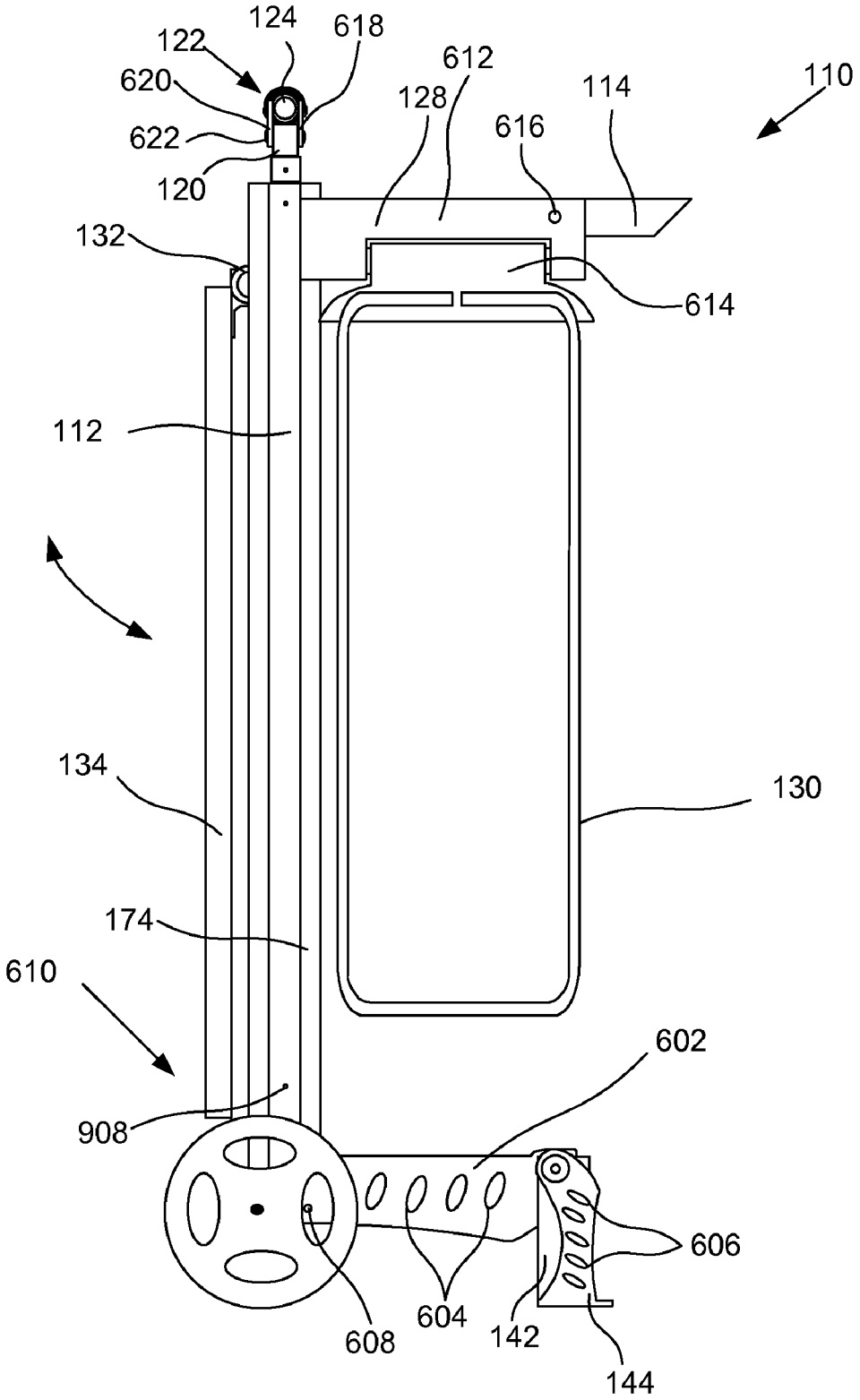
FIG. 7 is a side view illustrating one embodiment of a frame structure of a portable workstation in accordance with the present invention.

FIG. 6 and FIG. 7 illustrate a right side view and a left side view of the frame structure 110 respectively. In certain embodiments the right side view shown FIG. 6 and the left side view shown in FIG. 7 are substantially mirror images. Inner support legs 142 are connected to the fin 174 on the lower support leg braces 602. The lower support leg braces 602 may be connected to the fin 174 on the vertical support members 112 by rivets 608 near the bottom of the vertical support members 112. In certain embodiments the inner support legs 142 and the lower support leg braces 602 comprise a single unitary structure. In the embodiments shown in FIG. 6 and FIG. 7 the inner support legs 142 and the lower support leg braces 602 are individually formed and connected to each other by fastening means such as welding, riveting, screwing or other means which are well known in the art. To reduce the overall weight of the portable workstation frame structure 110, holes 604 may be constructed in the lower support leg brace 602. Similarly, to reduce weight of the portable workstation frame structure 110, holes 606 may be constructed in the outer support legs 606. Additional holes (not shown) may be constructed in inner support legs 142.

The embodiments illustrated in FIG. 6 and FIG. 7 show the rear table support frame 134 in the storage position 610. The rear table support frame 134 is connected to the vertical support members 112 by rear table hinge 132 and configured to pivot between a plurality of positions as described above with respect to FIG. 5.

Side table support frames 130 are connected to side table hinges 128 which are in turn connected to both the platform 114 and a fin 174 on the vertical support members 112. As described in further detail in relation to FIG. 8, the side table hinges 128 may comprise an upper hinge portion 612 and a lower hinge portion 614. The side table support frame 130 is connected to the lower hinge portion 614. Bolts 616 may be disposed through the upper hinge portion 612 and the platform 114 and connected to the bag attachment rod 115 to hold the bag attachment rod 115 in position.

As described in greater detail with relation to FIGS. 11A-11C, handle hinges 122 comprise a front plate 618 and a rear plate 620 substantially shaped in an "L" shape. Pins, rivets or bolts 622 may be disposed through the front plates 618, the rear plates 620 and the handle supports 120 or the handle shafts 124 to allow the handle shafts 124 to pivot in relation to the handle supports 120.

Figure 8:
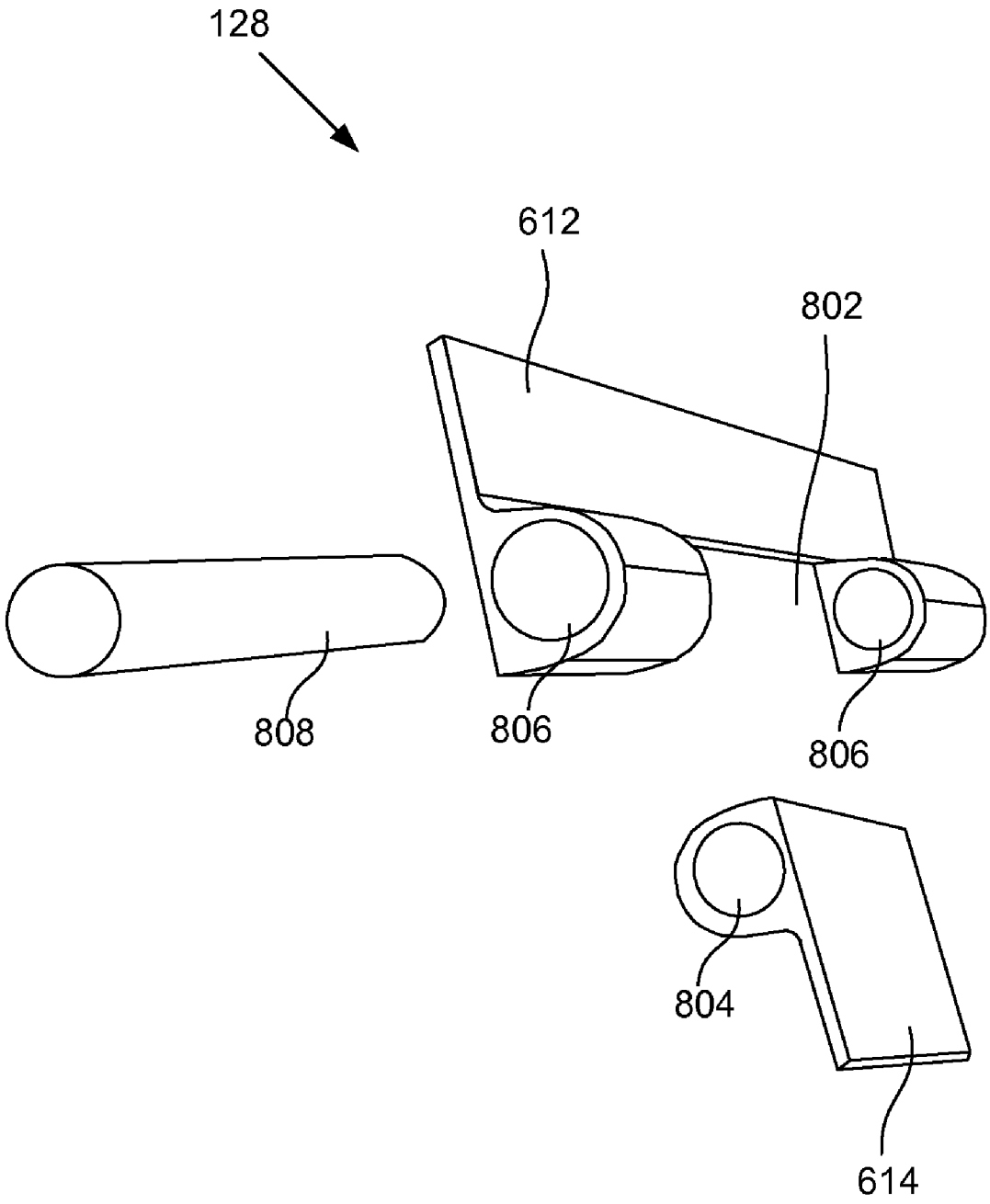
FIG. 8 is a perspective view illustrating one embodiment of a side table hinge in accordance with the present invention.

FIG. 8 illustrates one embodiment of the upper hinge portion 612 and lower hinge portion 614 of side table hinges 128. The upper portion 612 of side table hinge 128 may be attached to the vertical support member 112 such that the upper portion 612 of the side table hinge 128 does not move in relation to the vertical support member 112. The upper portion 612 and the lower portion of the side table hinge 128 may comprise an extruded material shaped in substantially the same form as the axle support member 140 illustrated in FIG. 4A and FIG. 4B. Thus the same extrusions may be used for the axle support member 140, the vertical support member mounting portion 502 of the rear table hinge 132, the rear table frame structure mounting portion 504 of the rear table hinge 132, the upper hinge portion 612 of the side table hinge 128 and the lower hinge portion 614 of the side table hinge 128. In this manner the number of extrusions may be limited allowing for large quantities of the single extrusion material to be a purchased at quantity discounts. As discussed above with reference to the rear table support hinge 132, the extrusion comprising side table hinge 128 may comprise one or more of a metal, plastic or composite material.

A notch 802 is removed from the upper hinge portion 612 of the side table hinge 128. The lower hinge portion 614 of the side table hinge 128 is slightly narrower than the notch 802 in the upper hinge portion 612. Thus, the void 804 in the lower hinge portion 614 may be aligned with the voids 806 in the upper hinge portion 612. A hinge shaft 808 is disposed through void 804 and voids 806 allowing the lower hinge portion 614 to pivot in relation to the upper hinge portion 612.

Figure 9:
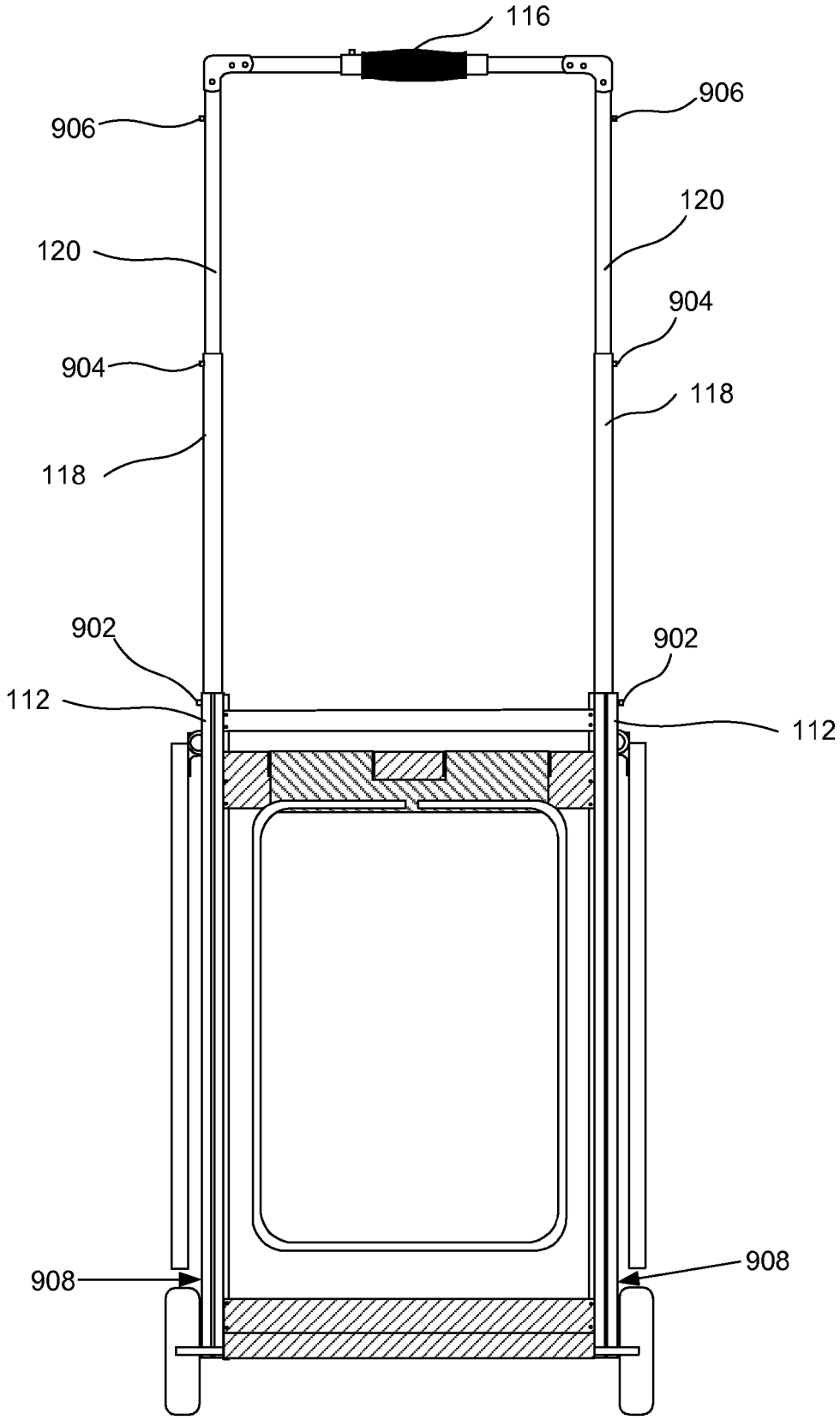
FIG. 9 is a rear view illustrating one embodiment of a frame structure with an extended handle in accordance with the present invention.
Figure 10:
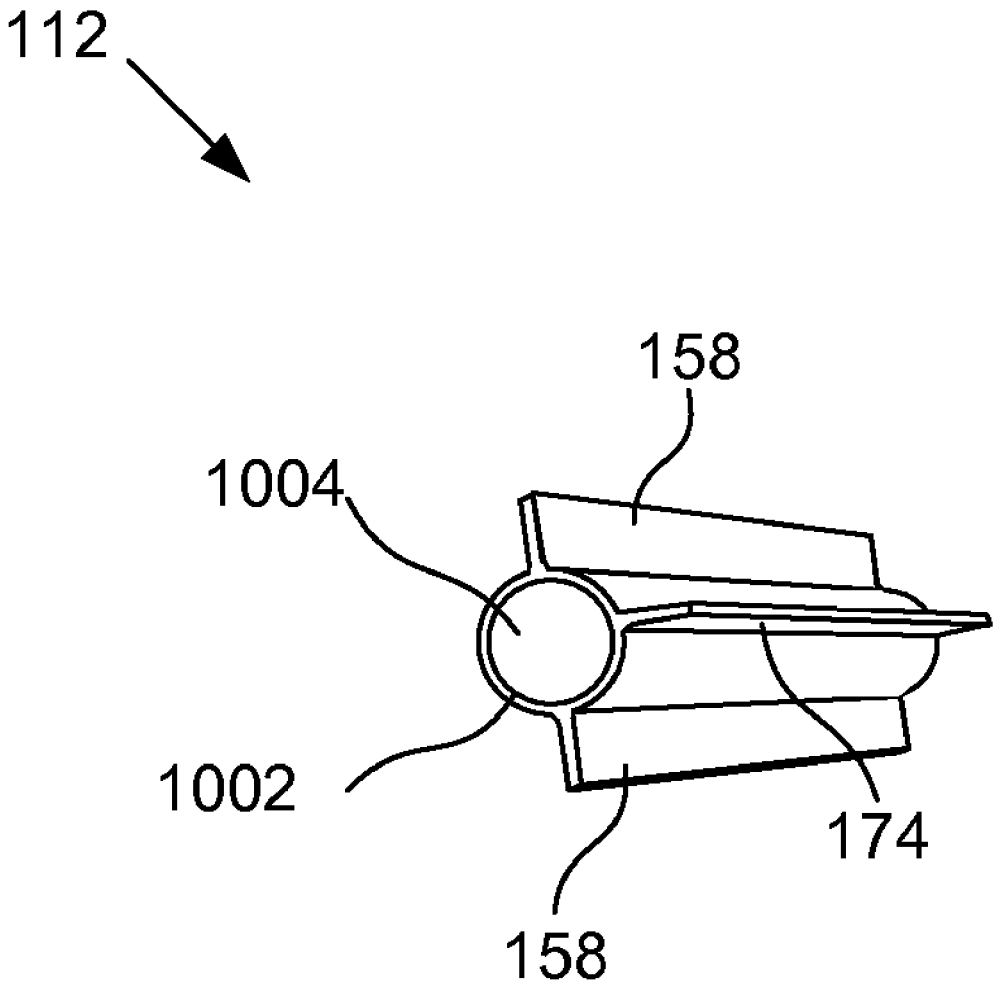
FIG. 10 is a perspective view illustrating one embodiment of a vertical support member in accordance with the present invention.

FIG. 9 illustrates an embodiment in which the additional vertical support members 118 are fully extended from within vertical support members 112. As illustrated in FIG. 10, the vertical support members 112 comprise a hollow tube 1002 with a plurality of fins 158 and 174 extending perpendicularly from and longitudinally along an outer surface of the hollow tube 1002. Fin 174 is disposed at a right angle in relation to fins 158. In certain embodiments the vertical support members 112 may comprise an extrusion comprising one or more of a metal, plastic or composite material. The additional vertical support members 118 comprise a hollow tube configured to slide within the hollow void 1004 in the vertical support member 118. When the additional vertical support members 118 are fully extended as shown in FIG. 9, push buttons 902 lock the additional vertical support members 118 in the extended position.

Handle support members 120 are slideably received within the additional vertical support members 118. When the handle support members 120 are fully extended as shown in FIG. 9, push buttons 904 lock the handle support members 120 in the extended position. Additional push buttons 906 may be provided to lock the handle support members 120 in a retracted position with the handle support members 120 fully inserted into the additional vertical support members 180. Holes 908 disposed in the side of vertical support members 112 may be configure to receive push buttons 902 and thereby lock the additional vertical support members 118 in a retracted position when the additional vertical support members 118 are fully inserted into vertical support members 112. Thus, when the handle support members 120 are fully inserted into the additional vertical support members 118 and the additional vertical support members 118 are fully inserted into the vertical support members 112, the push buttons 906 and push buttons 902 lock the handle 116 in a retracted storage or transport position. By depressing the push buttons 906 and push buttons 902 the additional vertical support members 118 and the handle support members 120 and thus the handle 116 may be extended to the position shown in FIG. 9.

FIGS. 11A through FIG. 11C illustrate one embodiment of the current invention in which the handle 116 is configured to allow handle shafts 124 to pivot one hundred and eighty degrees around handle hinges 122. In FIG. 11A push button 1102 is depressed thereby allowing the slideable sleeve 126 to slide in the direction indicated by the arrow. When the slideable sleeve 126 reaches the position shown in FIG. 11B push button 1102 locks the slideable sleeve 126 in the position shown in FIG. 11B thereby releasing handle shafts 124. Once the handle shafts 124 are released the handle shafts 124 may pivot around pivot point 1104 which may comprise a pin, bolt, rivet or other shaft as is known in the art. Thus, the handle shafts 124 may rotate from the storage or transport positions shown in FIGS. 11A and 11B to the extended positions shown in FIG. 11C. In the extended positions shown in FIG. 11C the handle shafts 124 may operate to provide a hanging bar for lanterns 1106 or other camping items.

Figure 12:
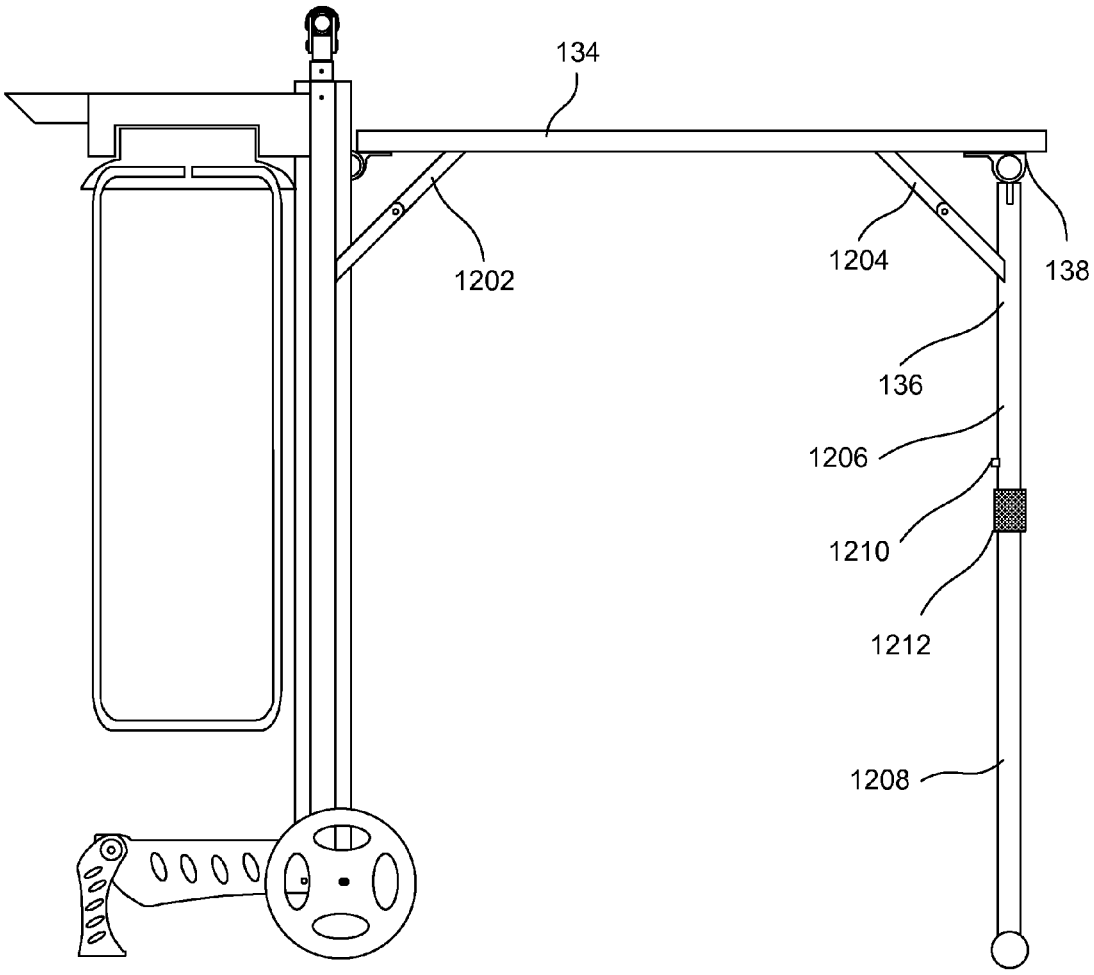
FIG. 12 is a side view illustrating one embodiment of a frame structure with a rear table support frame extended and a rear table support leg extended in accordance with the present invention.
Figure 13:
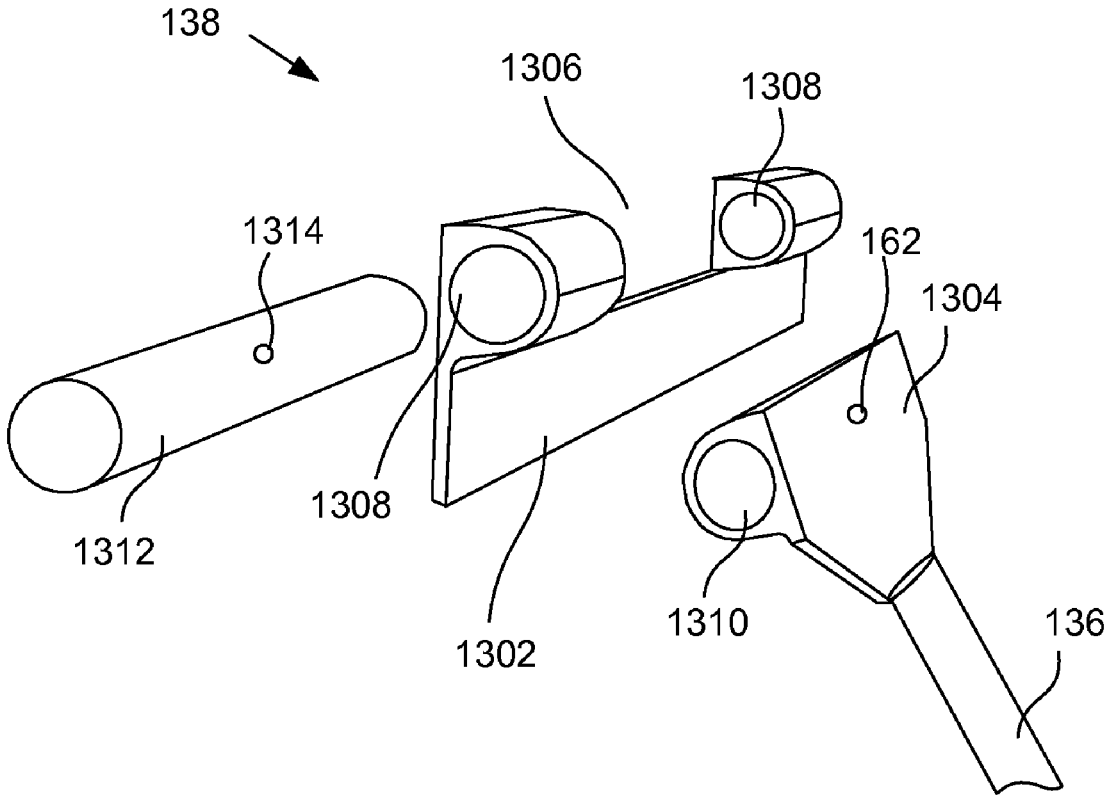
FIG. 13 is a perspective view illustrating one embodiment of a rear table support leg hinge in accordance with the present invention.

FIG. 12 illustrates an embodiment in which the rear table support frame 134 is pivotably attached to rear table support leg 136 by rear table support leg hinge 138. A strap hinge 1202 may be configured to lock the rear table support frame 134 in an extended position. Another strap hinge 1204 may be configured to lock the rear table support leg 136 in the extended support position shown if FIG. 12. The rear table support leg hinge 138 may be constructed in substantially the manner as shown in FIG. 13. The rear table leg upper hinge portion 1302 and the rear table leg lower hinge portion 1304 may be constructed of the same extrusions used in axle support member 140, the vertical support member mounting portion 502 of the rear table hinge 132, the rear table frame structure mounting portion 504 of the rear table hinge 132, the upper hinge portion 612 of the side table hinge 128 and the lower hinge portion 614 of the side table hinge 128. Thus, the number of extrusions necessary to construct the portable workstation 100 may be limited. Again, as discussed above the extrusions may comprise one or more of a metal, plastic or composite material. As with the other hinges, a notch 1306 may be formed in the rear leg upper hinge portion 1302. The notch 1306 may be of such a size as to receive the rear leg lower hinge portion 1304 and align hollow voids 1308 on the rear leg upper hinge portion 1302 with the hollow void 1310 on the rear leg lower hinge portion 1304. Hinge shaft 1312 may be inserted into hollow voids 1308 and hollow void 1310. In this fashion, the rear table support leg 136 may pivot in relation to the rear table support frame 134. Rear table locking pin hole 162 may align with a hole on the hinge shaft 1312 when the rear table support leg 136 is in a ninety degree angle in relation to the rear table support frame 134. A pin (not shown) may lock the rear table support leg 136 in a ninety degree angle in relation to the rear table support frame 134. One skilled in the art will recognize that this locking system may be used for each hinge mechanism discussed herein.

The rear table support leg 136 may comprise an upper tube 1206 slideably received within a lower tube 1208. A pin 1210 may be configured to lock the lower portion 1208 in an extended position such as is shown in FIG. 12. The upper tube 1206 and the lower tube 1208 may have a triangular profile to discourage the lower tube 1208 from rotating in relation to the upper tube 1206. One skilled in the art will recognize that other profiles may be used to discourage the rotation of the lower tube 1208 in relation to the upper tube 1206. In certain embodiments a compression nut 1212 is disposed on the upper tube to remove play between the upper tube 1206 and the lower tube 1208.

Figure 14:
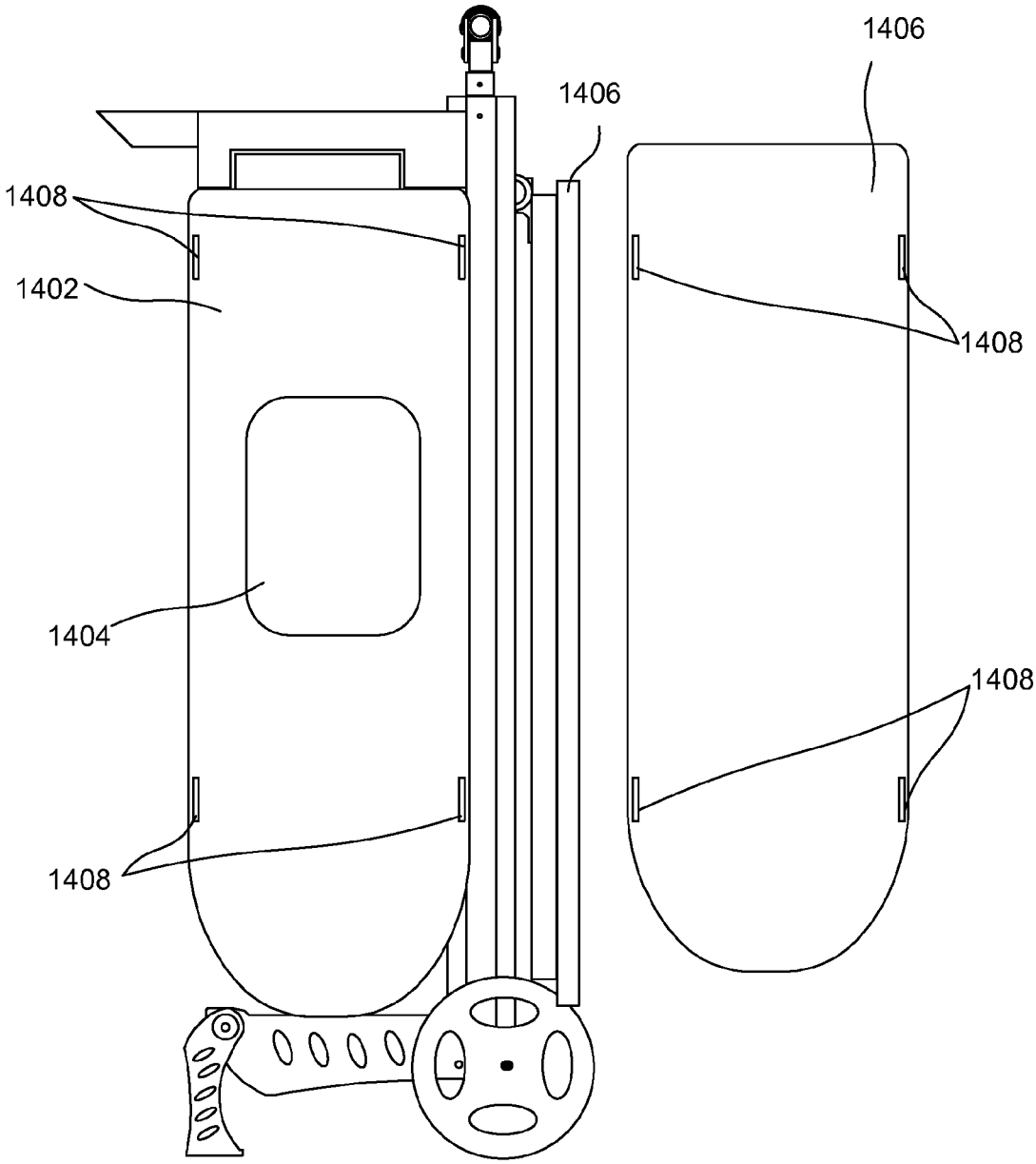
FIG. 14 is a side view illustrating a frame structure with a side table attached to a side table support frame and a rear table attached to a rear table support frame in accordance with the present invention.

FIG. 14 illustrates an embodiment of the current invention in which a table 1402 with a sink cutout 1404 is mounted on a side table support frame 130. In certain embodiments tables 1406 may be utilized which do not contain a sink cutout. Also illustrated in FIG. 14 is an embodiment in which a table 1406 may be connected to the rear table support frame. Attachment slots 1408 may disposed around the periphery of the table 1402 or table 1404.

Figure 15:
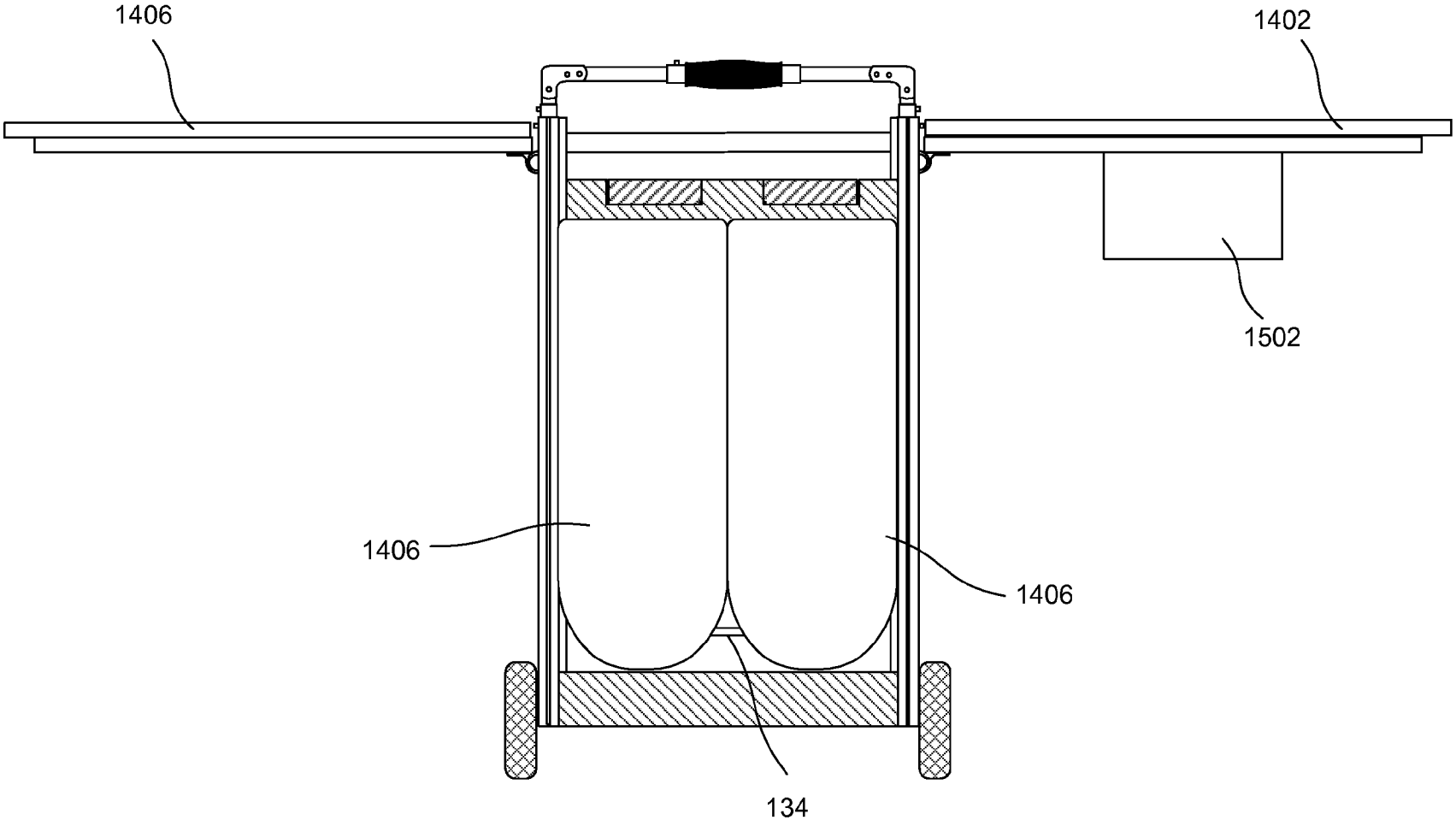
FIG. 15 is a rear view illustrating one embodiment of two tables attached to a rear table support frame and two side tables attached to two side table support frames with a sink basin attached to one of the side tables in accordance with the present invention.

FIG. 15 illustrates a rear view of one embodiment of the current invention in which two tables 1406 are disposed side by side on rear table support frame 134. In certain embodiments, a single rear table may cover the rear table support frame 134. A removable sink basin 1502 may be disposed in sink cutout 1404. In certain embodiments the sink basin 1502 may comprise a collapsible material such that the sink basin may be folded for storage or transport. In certain embodiments side tables 1402 or 1606 as well as side table support frames 120 may be removable for transport or storage.

Figure 16:
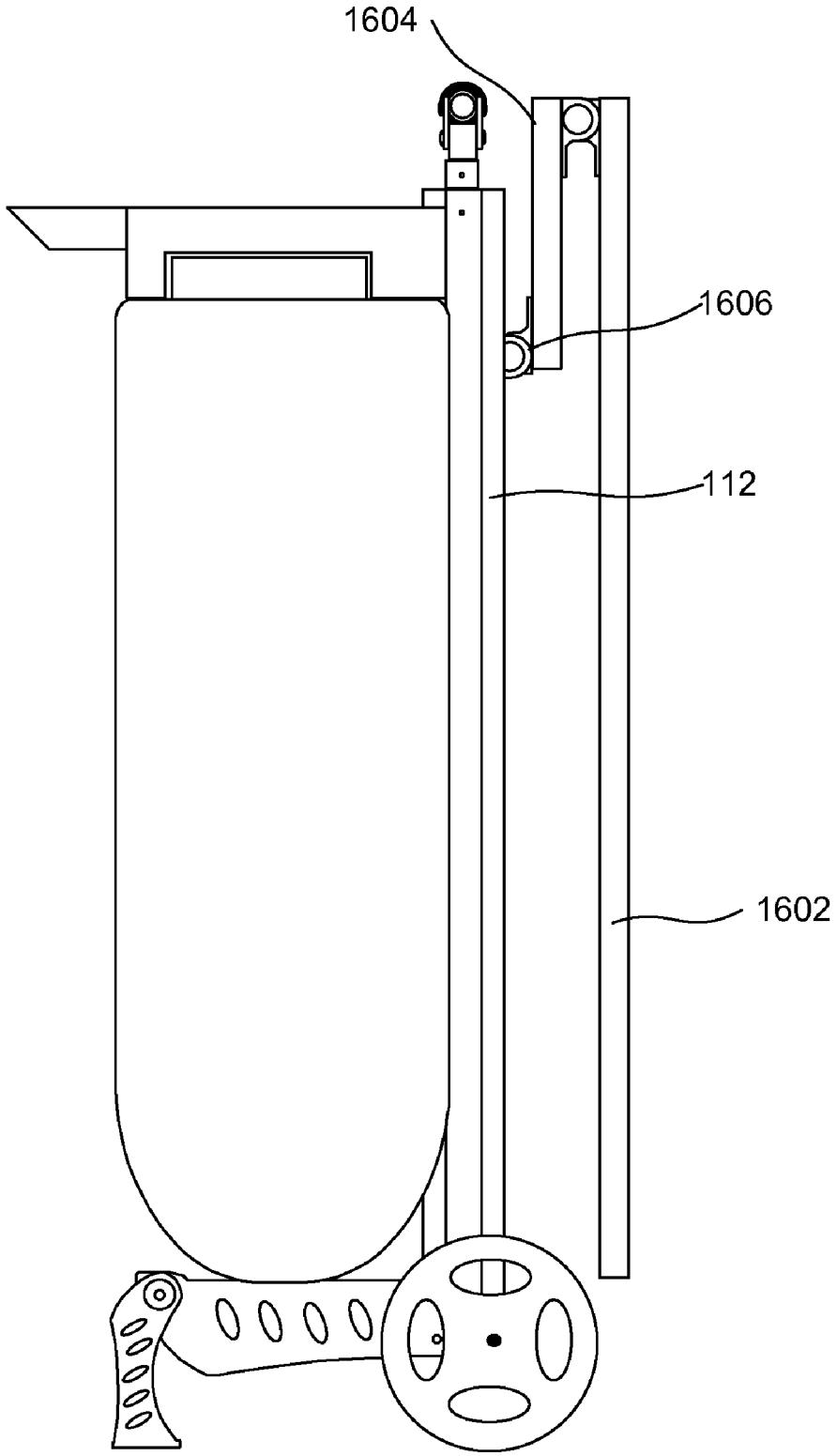
FIG. 16 is a side view illustrating one embodiment of a double hinge apparatus for attaching a rear table in accordance with the present invention.

FIG. 16 illustrates one embodiment of the current invention in which an extended rear table support frame 1602 is lifted to a higher position by a rear table support frame extension 1604. In this embodiment a first hinge 1606 pivotably attaches the rear table support frame extension 1604 to the vertical support members 112. A second hinge 1608 pivotably attaches the rear table support frame extension 1604 to the extended rear table support frame 1602. The rear table support frame length is dictated by the height above the ground at which the rear table support frame. By lifting the rear table support frame higher above the ground, a longer rear table may be incorporated into the portable workstation 100. One skilled in the art will recognize that similar double hinge mechanisms may be utilized to achieve longer side tables.

Figure 17:
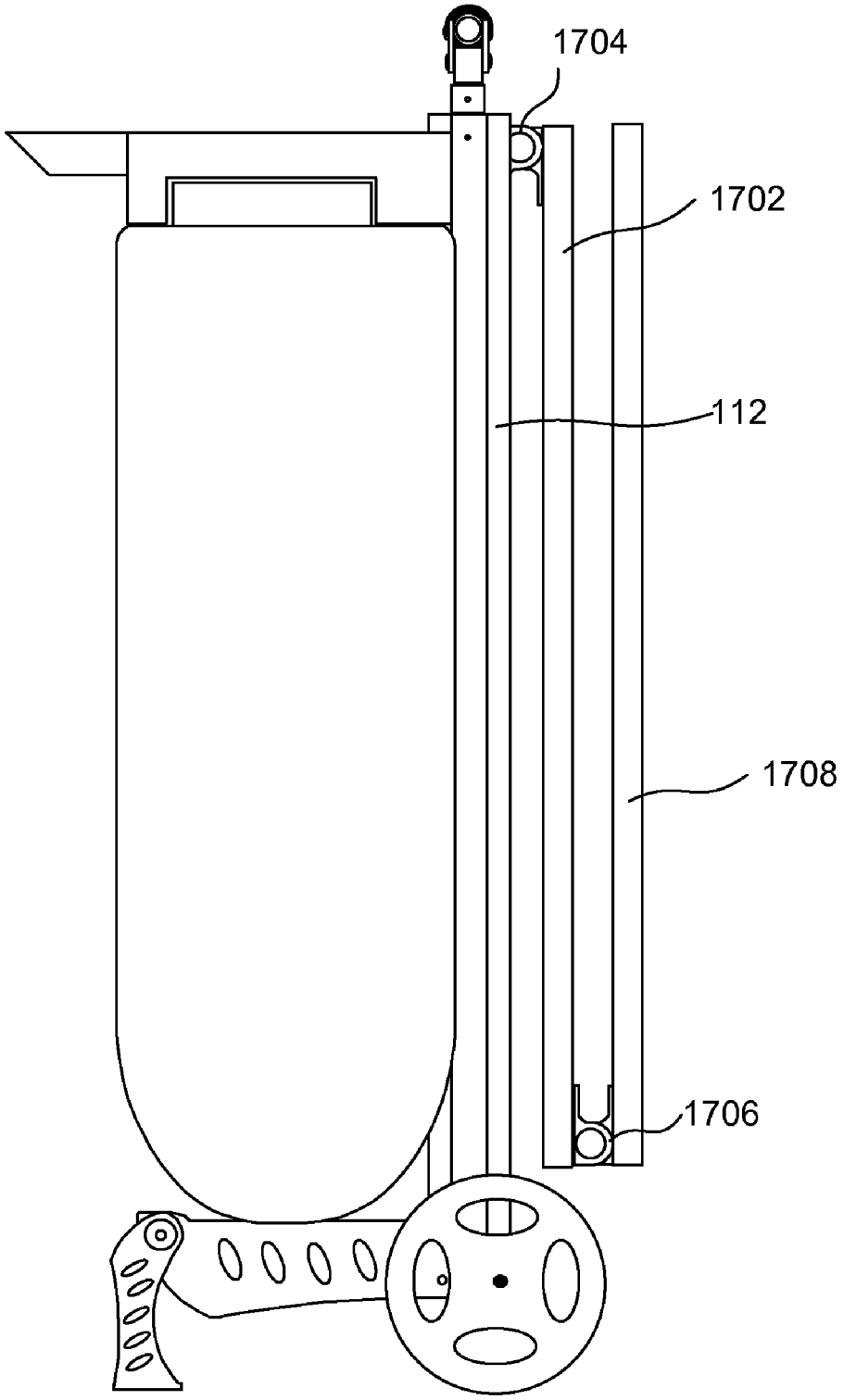
FIG. 17 is a side view illustrating one embodiment of a portable workstation with a first table hingedly connected to a second table in accordance with the present invention.

In the embodiment illustrated in FIG. 17 a first rear table section 1702 is pivotably attached to vertical support member 112 by a first hinge 1704. A second hinge 1706 attaches a second rear table section 1708. Thus, when fully extended, the rear table length may comprise the length of the first rear table section 1702 plus the length of the second rear table section 1708. One skilled in the art will recognize that in certain embodiments a rear table leg support, such as those described above, may be pivotably attached to the first rear table section 1702, the second rear table section 1708 or both to provide additional support to the portable workstation 100. In one embodiment the rear first rear table section 1702 may be removable such that the first rear able section 1702 and the second rear table section 1708 are temporarily attached to the frame structure for transit, then removed, folded out, and reattached to the frame structure 110 for usage.

Figure 18:
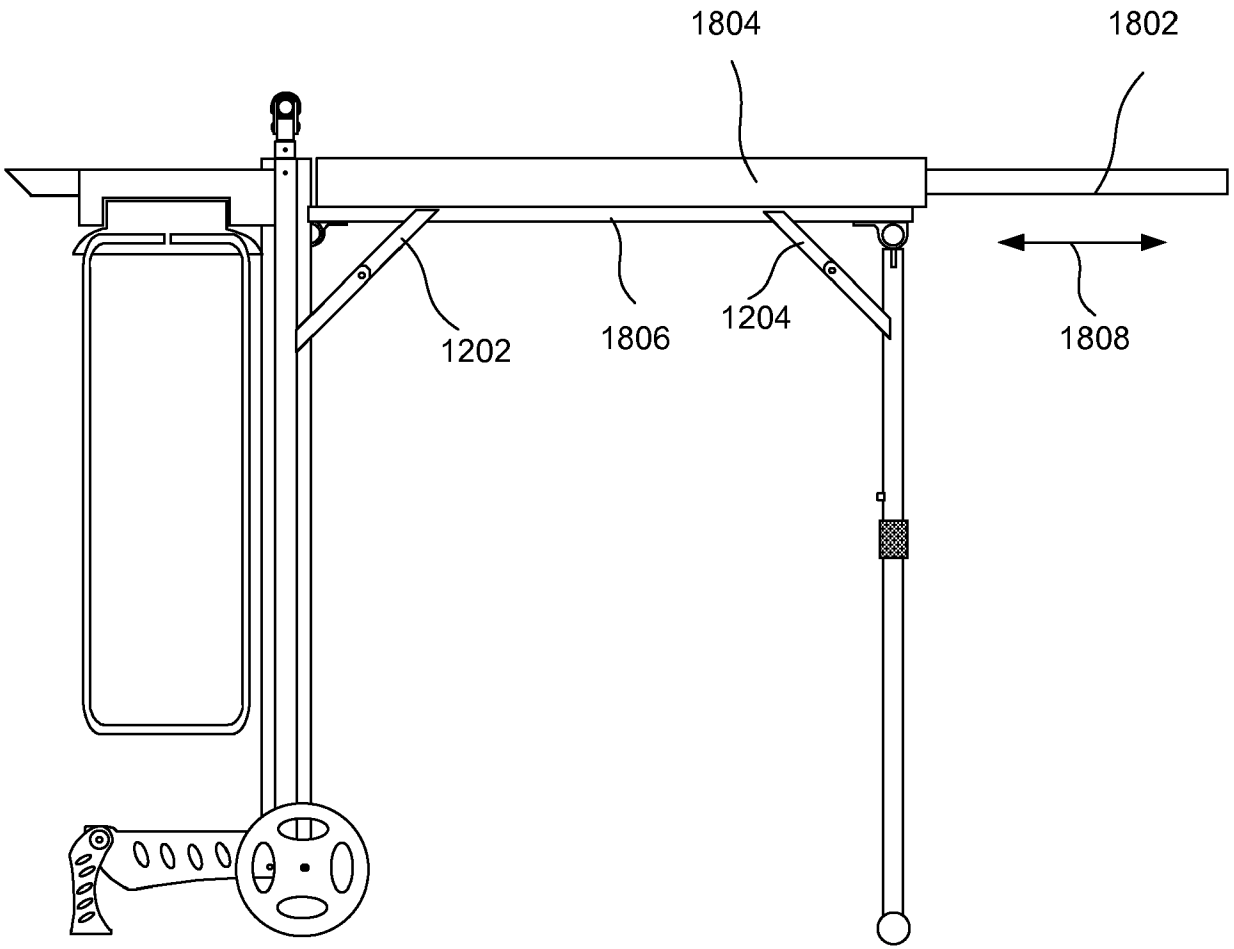
FIG. 18 is a side view illustrating one embodiment of a rear table extension slideably received in a rear table in accordance with the present invention.

FIG. 18 illustrates an embodiment in which a sliding rear table extension 1802 is slideably received within an orifice in the rear table 1804. The rear table 1804 may be attached to the frame structure 110 by means of a rear table support frame 1806 in substantially the same manner as described above. The sliding rear table extension 1802 may be configured to slide in the directions indicated by arrow 1808 from a stored position in which the sliding rear table extension is completely disposed within the orifice in rear table 1804 to an extended position in which the sliding rear table extension 1802 is extended to provide additional table space. The dimensions of the rear table 1804 may be sided to accommodate the sliding rear table extension 1802.

Figure 19:
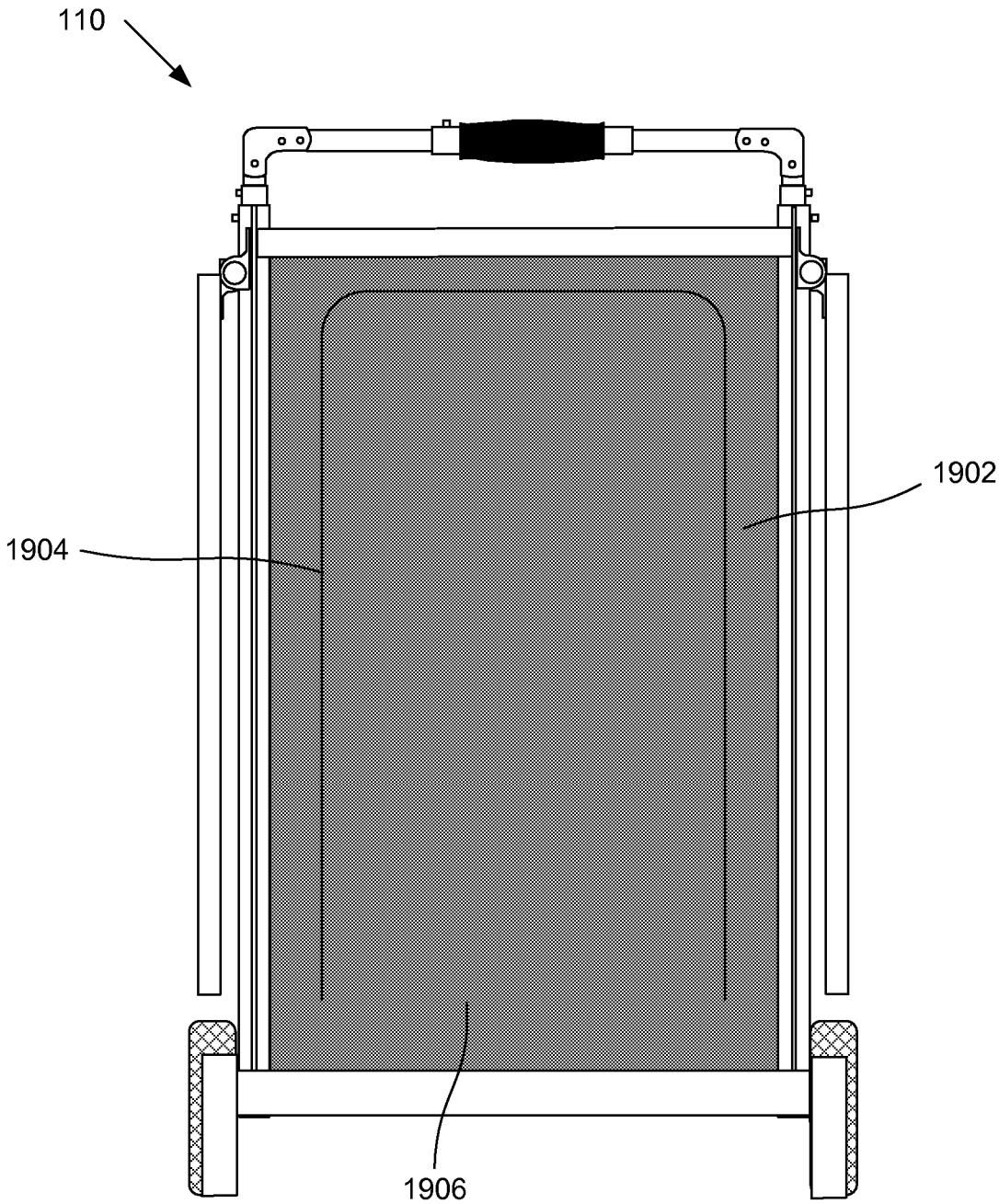
FIG. 19 is a front view illustrating one embodiment of a workstation with a container attached to a frame structure in accordance with the present invention.
Figure 20:
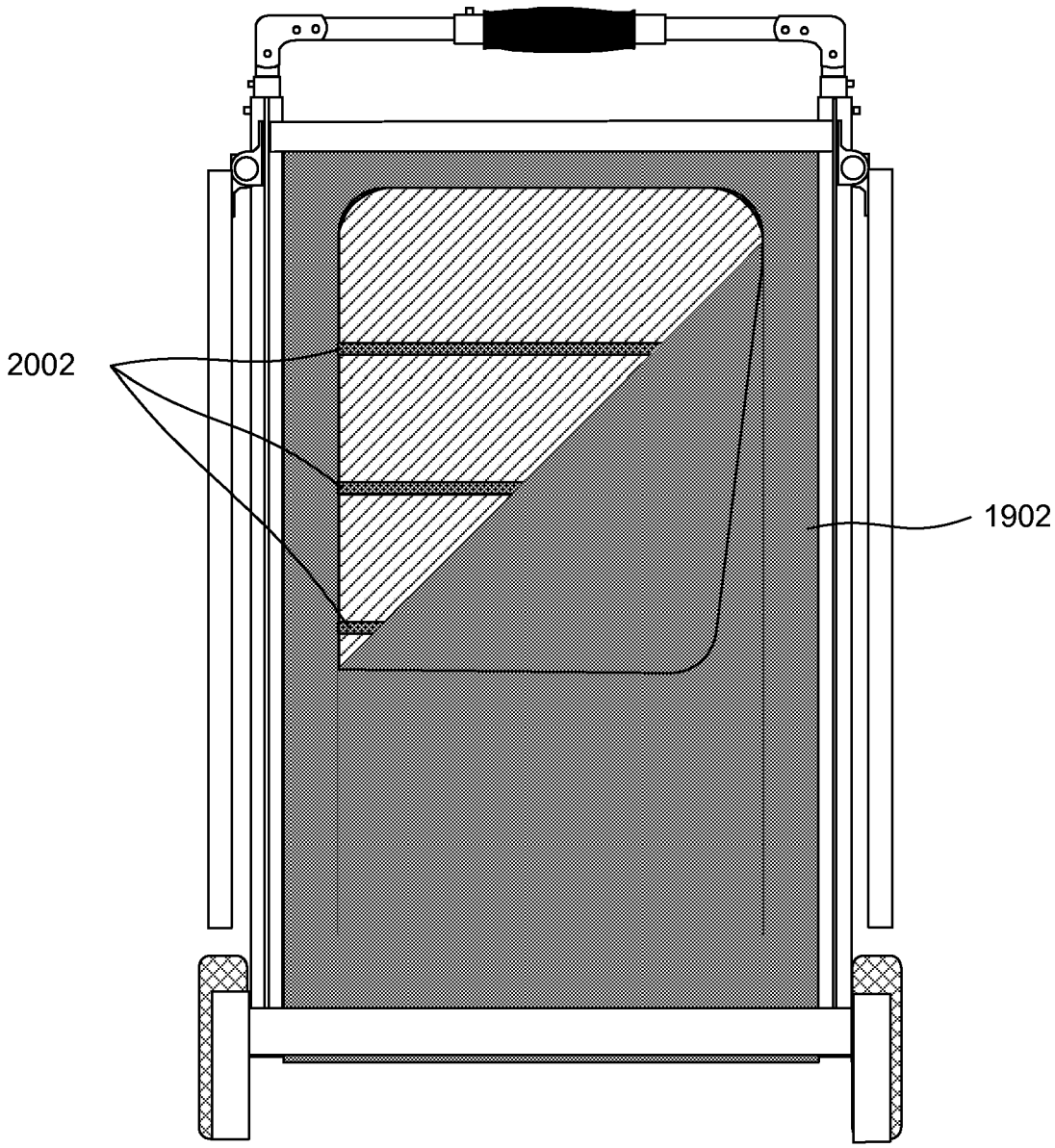
FIG. 20 is a front view illustrating one embodiment of a container with shelves disposed therein in accordance with the present invention.

In certain embodiments, such as the embodiment illustrated in FIG. 19, a container 1902 may be attached to the frame structure 110. In certain embodiments the container 1902 comprises a fabric bag attached to the bag attachment rod 115. In other embodiments the container 1902 may comprise a rigid material such as an injection molded plastic. A zipper 1904 may operated to retain items stored within the container 1902. The zipper 1904 may substantially circumvent the container except for the bottom portion 1906 of the container. As illustrated in FIG. 20, in certain embodiments a plurality of shelves 2002 may be disposed within the container 1902. Thus, when the portable workstation 100 is in the upright position items may be stored on the shelves 2002.

Figure 21:
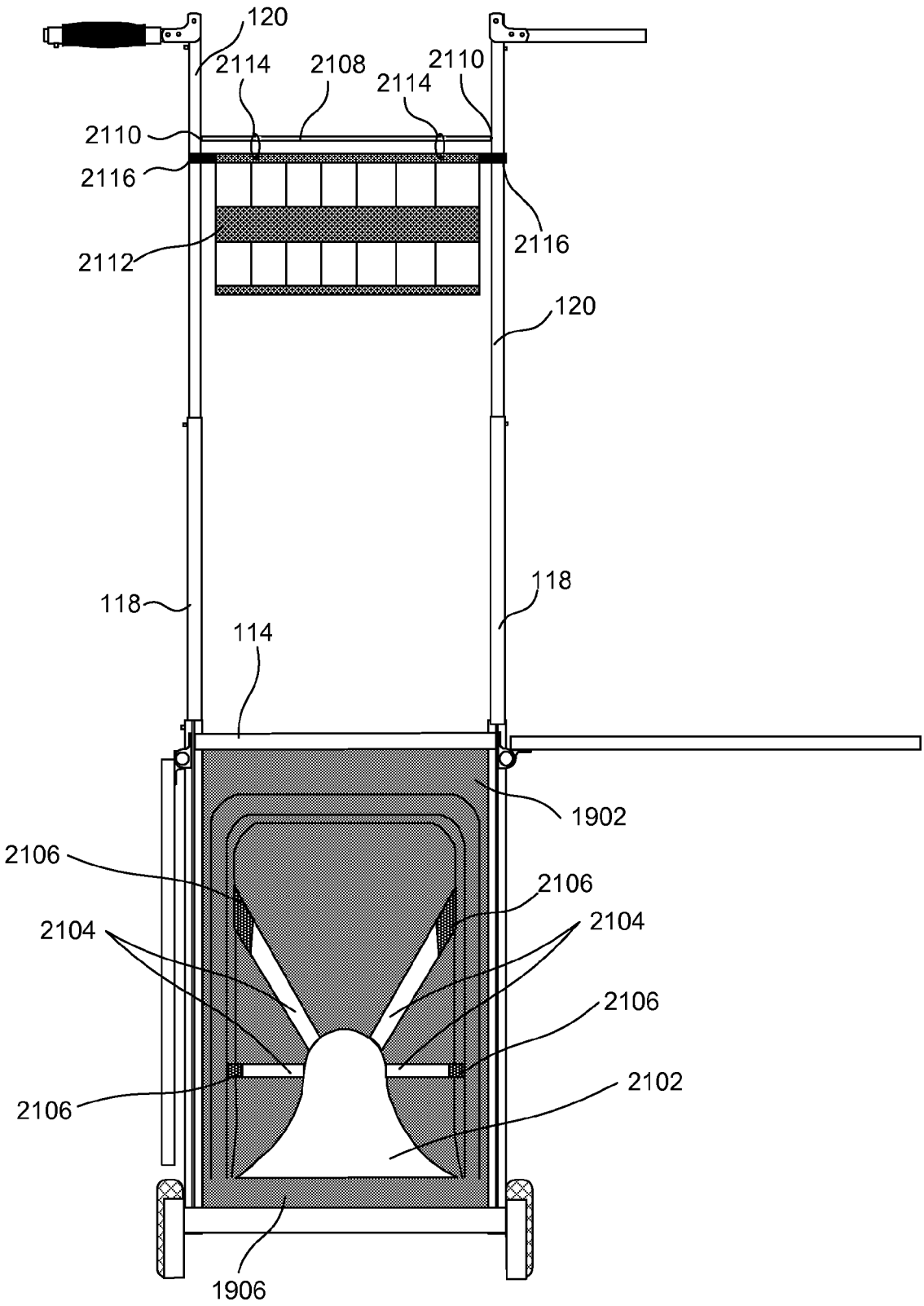
FIG. 21 is a front view illustrating one embodiment of a workstation with a stove support sleeve and a spice and utensil retaining bag in accordance with the present invention.

FIG. 21 illustrates an embodiment in which a stove support sleeve 2102 is attached to the front of the container 1902. The stove support sleeve 2102 may comprise a fabric sleeve sewn to the bottom 1906 of the container 1902. A plurality of straps 2104 may connect the top and sides of the stove support sleeve 2102 to the container 1902. In certain embodiments the straps 2104 may comprise a buckle, camming mechanism or other securing means 2106 to tighten the straps 2104 around a stove (not illustrated).

A bar 2108 may be removably disposed between handle supports 120. The bar 2108 may be inserted into holes 2110 preconfigured to receive the bar 2108 a predetermined distance above the platform 114 when the additional vertical support members 118 and handle support members 120 are fully extended. A spice and utensil retaining bag 2112 may be hung from the bar 2108 by retaining rings 2114 attached to the spice and utensil retaining bag 2112. To hang the spice and utensil retaining bag 2112 from the bar 2108, the bar 2108 is inserted through retaining rings 2114. The bar 2108 is then inserted into holes 2110 disposed in the handle supports 120. Straps 2116 are tightened around handle supports 120 pulling the handle supports 120 together to retain the bar 2108. In certain embodiments the spice and utensil retaining bag 2112 may comprise a plurality of pockets 2118 for organizing spices, utensils or other items.

What is claimed is:

1. A lightweight, compact, portable workstation, the workstation comprising:

a frame structure comprising at least one vertical support member, the at least one vertical support member comprising substantially hollow tubing and at least two fins extending perpendicularly from and longitudinally along an outer surface of the hollow tubing, wherein at least one horizontal member is coupled to at least one of the at least two fins;

a platform coupled to and extending horizontally from the at least one vertical support member, the platform forming a top to the frame structure in an upright position; and a first table configured to extend from the frame structure, the first table comprising at least one table support leg, wherein the first table is configured to alternate between an extended position and a storage position.

2. The apparatus of claim 1, further comprising a pair of inner support legs, each inner support leg coupled opposing sides of the frame structure opposite the platform, wherein the table extends from a third side of the frame structure with the table positioned in the extended position, the third side of the frame structure extending between the opposing sides of the frame structure, wherein the pair of inner support legs support the frame structure at each of the opposing sides of the frame structure and wherein the at least one table support leg supports the third side of the frame structure such that the pair of inner support legs and the at least one table support leg form an integrated tripod system to support the frame structure in the upright position.

3. The apparatus of claim 2, further comprising a pair of outer support legs coupled to a pair of support leg shafts, wherein each support leg shaft is slideably received within a support leg tube, wherein the pair of outer support legs are configured to nest with the pair of inner support legs in a first position, wherein each support leg shaft is configured to telescopically extend laterally from within the support leg tube the to reposition each of outer support legs in a second position to provide lateral support for maintaining the apparatus in the upright position.

4. The apparatus of claim 2, further comprising a second support leg, the second support leg configured to pivot around the first support leg to extend laterally from the frame structure to provide lateral support for maintaining the apparatus in an upright position.

5. The apparatus of claim 1, wherein the at least two fins are disposed at right angles in relation to one another.

6. The apparatus of claim 1, further comprising at least one handle support and a handle, the at least one handle support slideably received within at least one additional vertical support member and configured to slideably extend from within the at least one additional vertical support member, the at least one additional vertical support member slideably received within the hollow tubing of the at least one vertical support and configured to sideably extend from within the at least one vertical support, wherein the handle is coupled to the at least one handle support such that the handle extends with the at least one handle support.

7. The apparatus of claim 6, wherein the at least one vertical support comprises a first vertical support member and a second vertical support member, wherein the at least one handle support comprises a first handle support and a second handle support, and wherein the at least one additional vertical support member comprises a first additional vertical support member and a second additional vertical support member, the first additional vertical support member slideably received within the first vertical support member, the first handle support slideably received within the first additional vertical support member, the second additional vertical support member slideably received within the second vertical support member, the second handle support slideably received within the second additional vertical support member, wherein the handle comprises:

a first shaft rotatably coupled to the first handle support and configured to rotate from an inward position to an outward position;

a second shaft rotatably coupled to the second handle support and configured to rotate from an inward position to an outward position; and a slideable sleeve configured to detachably couple the first shaft and the second shaft.

8. The apparatus of claim 7, further comprising a locking mechanism configured to lock the slideable sleeve in a first position in which the first shaft is immovably coupled to the second shaft, the locking mechanism further configured to lock in a second position in which the first shaft and the second shaft are uncoupled.

9. The apparatus of claim 7, further comprising a bar removeably attached to the at least one handle support and the additional support, the bar configured to support a hanging bag.

10. The apparatus of claim 1, further comprising a second table configured to extend from the first table, wherein the second table is configured to alternate between an extended position and a storage position.

11. The apparatus of claim 10, wherein the second table is coupled to the first table by a hinge.

12. The apparatus of claim 10, further comprising a cavity disposed within the first table, the cavity configured to receive the second table, wherein the second table is configured to slideably extend from storage position to an extended position.

13. The apparatus of claim 1, further comprising a double hinge coupling the first table to the frame structure, the double hinge comprising a first pivot point disposed substantially above a second pivot point.

14. The apparatus of claim 1, wherein the first table is removeable.

15. A lightweight, compact, portable workstation, the workstation comprising:

a base unit comprising a pair of opposing vertical support members, each vertical support member comprising substantially hollow tubing and at least one fin extending perpendicularly from and longitudinally along an outer surface of the substantially hollow tubing;

at least one horizontal member positioned between the pair of opposing vertical support members, wherein the at least one horizontal member is coupled to the at least one fin of each of the vertical support members; and a pair of additional vertical support members slideably received within the substantially hollow tubing of the pair of vertical support members.

16. The apparatus of claim 15, further comprising a first support leg and a second support leg, the first support leg coupled to the base unit and configured to support the base unit in an upright position, the second support leg configured to nest with the first support leg in a first position, the second support leg further configured to extend laterally from the base unit in a second position, wherein the second support leg provides lateral support for maintaining the base unit in the upright position.

17. The apparatus of claim 15, further comprising at least one handle support and a handle, the at least one handle support slideably received within the substantially hollow tubing of at least one of the additional vertical support members and configured to slideably extend from within the at least one additional vertical support, the handle coupled to the at least one handle support such that the handle extends with the at least one handle support.

18. The apparatus of claim 17, further comprising an additional handle support slideably received within the substantially hollow tubing of the other of the additional vertical support members and configured to telescopically extend from the other of the additional vertical support members, wherein the handle comprises:

a first shaft rotatably coupled to the at least one handle support and configured to rotate from an inward position to an outward position;

a second shaft rotatably coupled to the additional handle support and configured to rotate from an inward position to an outward position; and a slideable sleeve configured to detachably couple the first shaft and the second shaft.

19. The apparatus of claim 18, further comprising a bar removeably attached to the at least one handle support and the additional support, the bar configured to support a hanging bag.

20. The apparatus of claim 15, further comprising a second table configured to extend from the first table.

21. The apparatus of claim 15, further comprising a double hinge coupling the first table to the base unit, the double hinge comprising a first pivot point disposed substantially above a second pivot point.

22. A lightweight, compact, portable workstation, the workstation comprising:

a base unit comprising a first vertical support member and a second vertical support member, each of the first and the second vertical support members comprising substantially hollow tubing and at least two fins extending perpendicularly from and longitudinally along outer surface of the hollow tubing;

at least one horizontal member positioned between the first vertical support member and the second vertical support member, the at least one horizontal member coupled to at least one of the at least two fins of the first vertical support member and at least one of the at least two fins of the second vertical support member;

a first additional vertical support member and a second additional support member, the first additional vertical support member slideably received within the substantially hollow tubing of the first vertical support member, the second additional vertical support member slideably received within the substantially hollow tubing of the second vertical support member;

a first table configured to extend from a top of the base unit, wherein the first table is configured to alternate between an extended position and a storage position;

a first handle support slideably received within the first additional vertical support member and configured to telescopically extend from the first additional vertical support member;

a second handle support slideably received within the second additional vertical support member and configured to telescopically extend from the second additional vertical support member; and a handle comprising:

a first shaft rotatably coupled to the first handle support and configured to rotate from an inward position to an outward position;

a second shaft rotatably coupled to the second handle support and configured to rotate from an inward position to an outward position; and a slideable sleeve configured to detachably couple the first shaft and the second shaft.

23. The apparatus of claim 22, further comprising a second table configured to extend from the first table.

24. A lightweight, compact, portable workstation, the workstation comprising:

a base unit, the base unit comprising at least one vertical support member, the at least one vertical support member comprising substantially hollow tubing and at least two fins extending perpendicularly from and longitudinally along an outer surface of the hollow tubing, wherein at least one horizontal member is coupled to at least one of the at least two fins;

a first table configured to extend from a top of the base unit, wherein the first table is configured to alternate between an extended position and a storage position; and a second table configured to extend from a side of the base unit, wherein the second table is configured to alternate between an extended position and a storage position.

25. The apparatus of claim 24, wherein the second table is removeable.

* * * * *

UNITED STATES PATENT AND TRADEMARK OFFICE

CERTIFICATE OF CORRECTION

PATENT NO. : 8,127,690 B2
APPLICATION NO. : 12/175315
DATED : March 6, 2012
INVENTOR(S) : Joe D. Baughman It is certified that error appears in the above-identified patent and that said Letters Patent is hereby corrected as shown below:

Column 4, Line 49
"profile view illustrated" --should read "profile view illustrating"

Column 6, Line 30
"within support leg" --should read "within the support leg"

Column 7, Line 64
"On skilled in" --should read "One skilled in"

Column 8, Line 23
"On skilled in" --should read "One skilled in"

Column 9, Line 65
"the vertical support vertical support members" --should read "the vertical support members"

Column 12, Line 24
"to be a purchased" --should read "to be purchased"

Column 12, Line 62
"may be configure" --should read "may be configured"

Column 13, Lines 33-34
"substantially the manner" --should read "substantially the same manner"

Column 14, Line 34
"support frame." --should read "support frame sits."

Column 14, Line 51
"first rear able" --should read "first rear table"

Signed and Sealed this
First Day of May, 2012

David J. Kappos

David J. Kappos
*Director of the United States Patent and Trademark Office*

Column 16, Line 11-12

"tube the to reposition" --should read "tube to reposition"

Column 16, Line 29

"to sideably extend" --should read "to slideably extend"